US008096823B2

(12) United States Patent
Tagawa et al.

(10) Patent No.: US 8,096,823 B2
(45) Date of Patent: Jan. 17, 2012

(54) ELECTRICAL CONNECTOR

(75) Inventors: Tetsuya Tagawa, Tokyo (JP); Hiroharu Ikari, Tokyo (JP)

(73) Assignee: I-Pex Co., Ltd. (JP)

( * ) Notice: Subject to any disclaimer, the term of this patent is extended or adjusted under 35 U.S.C. 154(b) by 0 days.

(21) Appl. No.: 13/061,686

(22) PCT Filed: Oct. 27, 2008

(86) PCT No.: PCT/JP2008/069466

§ 371 (c)(1),
(2), (4) Date: Mar. 1, 2011

(87) PCT Pub. No.: WO2010/029647

PCT Pub. Date: Mar. 18, 2010

(65) Prior Publication Data

US 2011/0165788 A1 Jul. 7, 2011

(30) Foreign Application Priority Data

Sep. 9, 2008 (JP) ..... 2008-230542

(51) Int. Cl.
*H01R 4/50* (2006.01)

(52) U.S. Cl. ..... 439/345

(58) Field of Classification Search ..... 439/345, 439/352, 372

See application file for complete search history.

(56) References Cited

U.S. PATENT DOCUMENTS 4,588,238 A * 5/1986 Mickelson et al. ..... 439/345
4,671,594 A * 6/1987 Ohtsuki et al. ..... 439/347
4,897,039 A * 1/1990 Uchida et al. ..... 439/372
5,681,175 A * 10/1997 Busse et al. ..... 439/157
6,095,830 A * 8/2000 Hirata et al. ..... 439/101
6,217,354 B1 * 4/2001 Fencl et al. ..... 439/157
6,305,957 B1 * 10/2001 Fink et al. ..... 439/157
6,558,176 B1 * 5/2003 Martin et al. ..... 439/157
6,682,359 B1 * 1/2004 Hitchcock et al. ..... 439/157
6,773,278 B2 * 8/2004 Valasek et al. ..... 439/157
6,824,406 B1 * 11/2004 Sharples et al. ..... 439/157

(Continued)

FOREIGN PATENT DOCUMENTS

JP 63-070334 U 5/1988

(Continued)

*Primary Examiner* — Tulsidas C Patel
*Assistant Examiner* — Vladimir Imas
(74) *Attorney, Agent, or Firm* — Studebaker & Brackett PC; Donald R. Studebaker

(57) ABSTRACT

An electrical connector comprising a manipulative lever operative to engage with a mating electrical connector, which has a body portion and a pair of end portions connected respectively with both ends of the body portion and supported respectively by a pair of supporting structures provided in a conductive shell covering partially an insulated housing, wherein each of the end portions of the manipulative lever comprises an elongated portion stretching to be bent from the body portion and a top end portion stretching further from the elongated portion so as to extend as a whole in a first direction from an end portion to a central portion of the insulated housing, the top end portion protrudes from the elongated portion in a direction perpendicular to an imaginary central axis of the elongated portion to form a stepped portion between the elongated portion and the top end portion, and a stopper member provided in the supporting structure engages with the stepped portion so as to prevent the end portion of the manipulative lever from getting out of the supporting structure when the end portion is shifted in a second direction opposite to the first direction.

9 Claims, 16 Drawing Sheets

U.S. PATENT DOCUMENTS

| | | | | |
|---|---|---|---|---|
| 6,830,469 | B1 * | 12/2004 | Doyle et al. | 439/247 |
| 7,063,547 | B2 * | 6/2006 | Toyoda et al. | 439/157 |
| 7,081,002 | B2 * | 7/2006 | de Vanssay et al. | 439/350 |
| 7,462,070 | B2 * | 12/2008 | Fukushima | 439/607.01 |
| 2003/0171022 | A1 * | 9/2003 | Distad et al. | 439/372 |
| 2003/0181084 | A1 * | 9/2003 | Valasek et al. | 439/157 |
| 2004/0077196 | A1 * | 4/2004 | Martin et al. | 439/152 |
| 2004/0171290 | A1 * | 9/2004 | Guzeldereli et al. | 439/157 |
| 2007/0042631 | A1 * | 2/2007 | Chen et al. | 439/372 |
| 2008/0032540 | A1 * | 2/2008 | Fukushima | 439/350 |
| 2008/0064250 | A1 * | 3/2008 | Lee et al. | 439/352 |
| 2009/0176399 | A1 * | 7/2009 | Desrosiers et al. | 439/345 |
| 2011/0207356 | A1 * | 8/2011 | Yamaji et al. | 439/345 |

FOREIGN PATENT DOCUMENTS

| | | | |
|---|---|---|---|
| JP | 64-013680 | | 1/1989 |
| JP | S64-13680 | U | 1/1989 |
| JP | H1-174878 | U | 12/1989 |
| JP | 2008-112700 | A | 5/2008 |

* cited by examiner

ELECTRICAL CONNECTOR

TECHNICAL FIELD

The present invention relates to an electrical connector with which a bundle of cables, a flexible printed circuit board (FPC) or the like is connected and which is put in engagement with a mating electrical connector mounted on a main circuit board, such as a solid printed circuit board, to be operative to connect electrically the cables, the FPC or the like with the mating connector.

TECHNICAL BACKGROUND

When a bundle of relatively slender cables, a relatively small-sized FPC or the like is electrically connected with a main circuit board, such as a solid printed circuit board, on which various electrical parts are directly mounted, there has been often proposed to use a first electrical connector on the side of cables or the like with which the cables or the FPC is connected and a second electrical connector on the side of a circuit board which is mounted on a main circuit board to be electrically connected with the same and with which the first electrical connector is engaged. The first electrical connector is operative to be a mating electrical connector to the second electrical connector and the second electrical connector is operative to be a mating electrical connector to the first electrical connector.

In such a case, the first electrical connector constitutes a plug type electrical connector comprising, for example, an insulated housing on which an engaging portion forming a connectively engaging protrusion on which a plurality of conductive contacts are arranged to be electrically connected respectively with the cables is provided. Usually, the first electrical connector constituting the plug type electrical connector comprises also a conductive shell or cover formed by means of processing a metal thin plate and mounted on the insulated housing for covering partially the same to be grounded for shielding the conductive contacts arranged on the engaging portion of the insulated housing from electromagnetic wave noise coming from the outside. The second electrical connector operative to be the mating electrical connector to the first electrical connector constitutes a receptacle type electrical connector comprising, for example, an insulated housing on which an engaging portion forming a connectively engaging opening into which the connectively engaging protrusion provided on the insulated housing of the first electrical connector is inserted is provided. In the connectively engaging opening provided on the insulated housing of the second electrical connector, portions of a plurality of conductive contacts, an end of each of which constitutes a terminal connected electrically with the main circuit board, are arranged. Usually, the second electrical connector constituting the receptacle type electrical connector comprises also a conductive shell or cover formed by means of processing a metal thin plate and mounted on the insulated housing for covering partially the same to be grounded for shielding the conductive contacts arranged in the insulated housing from electromagnetic wave noise coming from the outside. Under such a situation, when the connectively engaging protrusion provided on the insulating housing of the first electrical connector is inserted into the connectively engaging opening provided on the insulated housing of the second electrical connector to engage with the same, the conductive contacts of the first electrical connector come into contact respectively with the conductive contacts of the second electrical connector to be connected electrically with the same.

With the above-described first electrical connector constituting the plug type electrical connector with which the bundle of cables or the FPC is connected and the second electrical connector constituting the receptacle type electrical connector mounted on the main circuit board, when the engaging portion provided on the insulated housing of the first electrical connector to form the connectively engaging protrusion is engaged with the engaging portion provided on the insulating housing of the second electrical connector to form the connectively engaging opening, it is required that the first electrical connector is appropriately maintained in engagement with the second electrical connector. Accordingly, there have been proposed previously several measures or means for putting a couple of electrical connectors having engaging portions provided on respective insulating housings to be engaged with each other, such as the first and second electrical connectors mentioned above, in a condition wherein the engaging portions are appropriately maintained in engagement with each other.

In one of such previously proposed measures or means, one of the first and second electrical connectors, which has the engaging portion provided on the insulated housing to form the connectively engaging protrusion or opening, is provided with a manipulative lever or manipulative rod set to be rotatable in respect to the insulated housing thereof. When the engaging portion of the first electrical connector forming the connectively engaging protrusion is put in engagement with the engaging portion of the second electrical connector forming the connectively engaging opening, the manipulative lever or manipulative rod of one of the first and second electrical connectors is manipulated to rotate for engaging with the insulated housing of the other of the first and second electrical connectors so that the engaging portion of the first electrical connector is prevented from getting out of the engaging portion of the second electrical connector. (As disclosed in, for example, patent document 1).

In such a pair of first and second electrical connectors to which the previously proposed measure or means is applied, as shown in the patent document 1 published previously, wherein the connectively engaging protrusion provided on the insulated housing of the first electrical connector (the plug type electrical connector) is put in engagement with the connectively engaging opening provided on the insulated housing of the second electrical connector (the receptacle type electrical connector), the first electrical connector is provided with a rotatable manipulative lever (a locking lever) which is mounted on the insulated housing having an outside surface thereof covered partially by the conductive shell and the second electrical connector is provided with a holding portion which is formed in the conductive shell covering partially an outside surface of the insulated housing and operative to engage with the rotatable manipulative lever of the first electrical connector for holding the same. The rotatable manipulative lever mounted on the insulated housing of the first electrical connector is made of material shaped into a bar to have a main manipulatable portion including a central portion of the rotatable manipulative lever and a pair of end portions provided at both ends of the main manipulatable portion. Each of the end portions of the rotatable manipulative lever is folded back from the end of the main manipulatable portion so that a top end of one of the end portions is opposite to a top end of the other of the end portions. The end portions thus formed constitute a pair of rotary axes which are loosely inserted respectively in both end portions in a longitudinal direction of the insulated housing to be rotatably held by the insulated housing. The holding portion formed in the conductive shell of the second electrical connector is shaped into a cantilever spring projecting from a part of the conductive shell (a board connecting portion).

When the connectively engaging protrusion provided on the insulated housing of the first electrical connector is engaged with the connectively engaging opening provided on the insulated housing of the second electrical connector, the rotatable manipulative lever mounted on the insulated housing of the first electrical connector is manipulated to rotate so that the main manipulatable portion of the rotatable manipulative lever is caused to come close to a portion of the insulated housing of the second electrical connector, which is opposite to the connectively engaging opening provided thereon, and then to ride across the holding portion formed in the conductive shell of the second electrical connector so as to engage with the same. Thereby, the main manipulatable portion of the rotatable manipulative lever is held by the holding portion so that a condition wherein the first and second electrical connectors are engaged with each other is stably maintained and the connectively engaging protrusion provided on the insulated housing of the first electrical connector is prevented from getting out of the connectively engaging opening provided on the insulated housing of the second electrical connector.

Patent Document 1: Japanese Patent Publication No. 2008-112700 (Pages 4 to 6, FIGS. 1 to 5)

DISCLOSURE OF THE INVENTION

Problems Intended to be Solved by the Invention

In the previously proposed first and second electrical connectors mentioned above, the rotatable manipulative lever of the first electrical connector, which is held by the holding portion formed in the conductive shell of the second electrical connector when the connectively engaging protrusion provided on the insulated housing of the first electrical connector is engaged with the connectively engaging opening provided on the insulated housing of the second electrical connector, is mounted on the insulated housing of the first electrical connector with the end portions thereof constituting respectively the rotary axes which are loosely inserted respectively in both end portions in the longitudinal direction of the insulated housing of the first electrical connector to be rotatably held by the same. Accordingly, when each of the end portions of the rotatable manipulative lever, which constitutes the rotary axis, is moved toward the outside of the insulated housing of the first electrical connector, the end portion of the rotatable manipulative lever is easily caused to get out of the insulated housing of the first electrical connector. That is, when an external force acts on the rotatable manipulative lever of the first electrical connector so as to move at least one of the end portions of the rotatable manipulative lever toward the outside of the insulated housing of the first electrical connector, it is seriously feared that the end portion of the rotatable manipulative lever is unwillingly caused to get out of the insulated housing of the first electrical connector so that the rotatable manipulative lever can not perform its assigned duty.

Further, in the previously proposed first and second electrical connectors mentioned above wherein the rotatable manipulative lever of the first electrical connector is mounted on the insulated housing of the first electrical connector with the end portions thereof constituting respectively the rotary axes which are loosely inserted respectively in both end portions in the longitudinal direction of the insulated housing of the first electrical connector to be rotatably held by the same, there is another disadvantage that when the main manipulatable portion of the rotatable manipulative lever is caused to come close to the portion of the insulated housing of the second electrical connector, which is opposite to the connectively engaging opening provided thereon, and then to ride across the holding portion formed in the conductive shell of the second electrical connector so as to engage with the same, a vacant space is formed between each of the end portions of the rotatable manipulative lever constituting the rotary axis and the insulated housing of the first electrical connector into which the end portion of the rotatable manipulative lever is loosely inserted and thereby another vacant space is formed between the main manipulatable portion of the rotatable manipulative lever and the second electrical connector so that the rotatable manipulative lever comes to unsteadiness so as to produce an undesirable noise.

Accordingly, it is an object of the present invention to provide an electrical connector comprising an insulated housing, a conductive shell covering partially the insulated housing, an engaging portion provided on the insulated housing with a plurality of conductive contacts arranged thereon and operative to engage with a mating engaging portion provided on an insulated housing of a mating electrical connector so as to cause the conductive contacts to come into contact with a plurality of conductive contacts provided in the mating electrical connector, and a manipulative lever having a pair of end portions thereof supported to be rotatable by the conductive shell and operative to engage with the mating electrical connector for maintaining stably a condition wherein the engaging portion is engaged with the mating engaging portion of the mating electrical connector, in which each of the end portions of the manipulative lever can be surely prevented from getting out of the conductive shell unwillingly and which avoids surely an undesirable condition wherein a vacant space is formed between the manipulative lever put in engagement with the mating electrical connector and the subject mating electrical connector and thereby the manipulative lever comes to unsteadiness so as to produce an undesirable noise.

Approach to Solve the Problems

According to the present invention claimed in any one of claims 1 to 9, there is provided an electrical connector, which comprises an insulated housing on which a first engaging portion is provided for engaging with a second engaging portion provided in a mating electrical connector, a plurality of first conductive contacts provided on the insulated housing with portions thereof arranged on the first engaging portion and operative to come into contact with a plurality of second conductive contacts provided in the mating electrical connector when the first engaging portion is put in engagement with the second engaging portion, a conductive shell for covering partially the insulated housing, and a manipulative lever having a body portion and a pair of end portions extending respectively from both ends of the body portion, in which the end portions are supported respectively by a pair of supporting structures provided in the conductive shell to be rotatable in regard to the insulated housing and which is operative to be manipulated to rotate so as to cause the body portion to engage with the mating electrical connector when the first engaging portion is put in engagement with the second engaging portion, wherein each of the end portions of the manipulative lever comprises an elongated portion stretching to be bent from the body portion and a top end portion stretching further from the elongated portion so as to extend as a whole in a first direction from an end portion to a central portion of the insulated housing, the top end portion protrudes from the elongated portion in a direction perpendicular to an imaginary central axis of the elongated portion, and a stopper member provided in the supporting structure engages with the top end portion so as to prevent the end portion of the manipulative lever from getting out of the supporting structure when the end portion of the manipulative lever is shifted in a second direction opposite to the first direction under a condition wherein the end portion of the manipulative lever is supported by the supporting structure.

Especially, in a first example of the electrical connector according to the present invention, as claimed in claim 2, each of the end portions of the manipulative lever comprising the elongated portion and the top end portion and supported by the supporting structure provided in the conductive shell is operative to exert, on the manipulative lever with the body portion thereof put in engagement with the mating electrical connector, such a pressure as to press the body portion of the manipulative lever against the mating electrical connector.

In a second example of the electrical connector according to the present invention, as claimed in claim 4, each of the end portions of the manipulative lever has the top end portion which protrudes from the elongated portion in the direction perpendicular to the imaginary central axis of the elongated portion so as to form a stepped portion between the elongated portion and the top end portion and the stopper member provided in the supporting structure engages with the stepped portion so as to prevent the end portion of the manipulative lever from getting out of the supporting structure when the top end portion is shifted in the second direction opposite to the first direction under the condition wherein the end portion of the manipulative lever is supported by the supporting structure.

Further, in a third example of the electrical connector according to the present invention, as claimed in claims 5, each of the end portions of the manipulative lever has the top end portion which is bent to protrude from the elongated portion in the direction perpendicular to the imaginary central axis of the elongated portion and in a fourth example of the electrical connector according to the present invention, as claimed in claims 6, each of the end portions of the manipulative lever has the top end portion which is compressed in a third direction perpendicular to the imaginary central axis of the elongated portion so as to protrude from the elongated portion in a fourth direction perpendicular to each of the imaginary central axis of the elongated portion and the third direction.

In the electrical connector thus constituted in accordance with the present invention, the manipulative lever which has the body portion and the end portions, each of which extends from the end of the body portion and is supported by the supporting structure provided in the conductive shell to be rotatable in regard to the insulated housing, is operative to be manipulated to rotate so as to cause the body portion to engage with the mating connector when the first engaging portion is put in engagement with the second engaging portion. Then, each of the end portions of the manipulative lever comprises the elongated portion stretching to be bent from the body portion and the top end portion stretching further from the elongated portion so as to extend as a whole in the first direction from the end portion to the central portion of the insulated housing and the top end portion protrudes from the elongated portion in the direction perpendicular to the imaginary central axis of the elongated portion. Thereby, each of the end portions of the manipulative lever is prevented from getting out of the supporting structure by the stopper member which is provided in the supporting structure for engaging with the top end portion when the end portion of the manipulative lever is shifted in the second direction opposite to the first direction under the condition wherein the end portion is supported by the supporting structure.

In the first example of the electrical connector according to the present invention claimed in claim 2, each of the end portions of the manipulative lever comprising the elongated portion and the top end portion and supported by the supporting structure provided in the conductive shell is operative to exert, on the manipulative lever manipulated for causing the body portion thereof to engage with the mating electrical connector, the pressure which is operative to press the body portion of the manipulative lever against the mating electrical connector when the first engaging portion is put in engagement with the second engaging portion provided in the mating electrical connector. The pressure thus exerted on the manipulative lever is brought about by each of the supporting structures which is provided with the stopper member and operative to allow the top end portion of the manipulative lever to shift a protruding direction thereof in response to the rotary movement of the manipulative lever.

In the second example of the electrical connector according to the present invention claimed in claim 4, the top end portion of each of the end portions of the manipulative lever protrudes from the elongated portion of the manipulative lever in the direction perpendicular to the imaginary central axis of the elongated portion so as to form the stepped portion between the elongated portion and the top end portion. Thereby, each of the end portions of the manipulative lever is prevented from getting out of the supporting structure by the stopper member which is provided in the supporting structure for engaging with the stepped portion when the top end portion is shifted in the second direction opposite to the first direction under the condition wherein the end portion is supported by the supporting structure.

Further, in the third example of the electrical connector according to the present invention claimed in claim 5 or the fourth example of the electrical connector according to the present invention claimed in claim 6, the top end portion of each of the end portions of the manipulative lever is bent to protrude from the elongated portion in the direction perpendicular to the imaginary central axis of the elongated portion or compressed in the third direction perpendicular to the imaginary central axis of the elongated portion so as to protrude from the elongated portion in the fourth direction perpendicular to each of the imaginary central axis of the elongated portion and the third direction.

Effect and Advantages of the Invention

With the electrical connector according to the present invention mentioned above, the manipulative lever has, in addition to the body portion, the end portions extending respectively from the ends of the body portion to be supported respectively by the supporting structures provided in the conductive shell, each of which comprises the elongated portion stretching to be bent from the body portion and the top end portion stretching further from the elongated portion so as to extend as a whole in the first direction from the end portion to the central portion of the insulated housing, and the top end portion protrudes from the elongated portion in the direction perpendicular to the imaginary central axis of the elongated portion, so that each of the end portions of the manipulative lever is prevented from getting out of the supporting structure by the stopper member which is provided in the supporting structure for engaging with the top end portion when the end portion is shifted in the second direction opposite to the first direction under the condition wherein the end portion is supported by the supporting structure. Accordingly, each of the end portions of the manipulative lever can be surely prevented from getting out of the conductive shell unwillingly so that the manipulative lever can be maintained in a condition for performing properly its assigned duty even when an external force acts on the manipulative lever so as to move at least one of the end portions of the manipulative lever toward the outside of the insulated housing.

Especially, with the first example of the electrical connector according to the present invention claimed in claim 2, since each of the end portions of the manipulative lever comprising the elongated portion and the top end portion and supported by the supporting structure provided in the conductive shell is operative to exert, on the manipulative lever manipulated for causing the body portion thereof to engage with the mating electrical connector, the pressure which is operative to press the body portion of the manipulative lever against the mating electrical connector when the first engaging portion is put in engagement with the second engaging portion provided in the mating electrical connector, in addition to an advantage that each of the end portions of the manipulative lever can be surely prevented from getting out of the conductive shell unwillingly so that the manipulative lever can be maintained in a condition for performing properly its assigned duty, another advantage that an undesirable condition wherein a vacant space is formed between the manipulative lever put in engagement with the mating electrical connector and the subject mating electrical connector and thereby the manipulative lever comes to unsteadiness so as to produce an undesirable noise can be surely avoided, is obtained.

In the second example of the electrical connector according to the present invention claimed in claim 4, each of the end portions of the manipulative lever has the top end portion which protrudes from the elongated portion in the direction perpendicular to the imaginary central axis of the elongated portion so as to form a stepped portion between the elongated portion and the top end portion and the stepped portion is easily formed on the end portion of the manipulative lever to take its place in a relatively small space so that the stopper member provided in the supporting structure is able to engage surely with the stepped portion. Accordingly, with the stepped portion thus easily formed on the end portion of the manipulative lever to take its place in the relatively small space, the end portion of the manipulative lever can be surely prevented from getting out of the supporting structure and an undesirable condition wherein a vacant space is formed between the manipulative lever put in engagement with the mating electrical connector and the subject mating electrical connector and thereby the manipulative lever comes to unsteadiness so as to produce an undesirable noise can be surely avoided.

Further, in the third example of the electrical connector according to the present invention claimed in claim 5 or the fourth example of the electrical connector according to the present invention claimed in claim 6, the top end portion of each of the end portions of the manipulative lever is bent to protrude from the elongated portion in the direction perpendicular to the imaginary central axis of the elongated portion or compressed in the third direction perpendicular to the imaginary central axis of the elongated portion so as to protrude from the elongated portion in the fourth direction perpendicular to each of the imaginary central axis of the elongated portion and the third direction, and such a top end portion is easily formed on the end portion of the manipulative lever to take its place in a relatively small space so that the stopper member provided in the supporting structure is able to engage surely with the top end portion. Accordingly, with the top end portion thus easily formed on the end portion of the manipulative lever to take its place in the relatively small space, the end portion of the manipulative lever can be surely prevented from getting out of the supporting structure and an undesirable condition wherein a vacant space is formed between the manipulative lever put in engagement with the mating electrical connector and the subject mating electrical connector and thereby the manipulative lever comes to unsteadiness so as to produce an undesirable noise can be surely avoided.

DESCRIPTION OF REFERENCES IN THE DRAWINGS

11 . . . electrical connector, 12 . . . coaxial cables, 13, 41 . . . insulated housing, 14, 42 . . . conductive shell, 15 . . . conductive cover, 16, 56, 76 . . . manipulative lever, 16A . . . manipulative tag, 17 . . . connectively engaging protrusion, 18, 44 . . . conductive contacts, 19*a*, 19*b*, 59*a*, 59*b*, 79*a*, 79*b* . . . curved arm portion, 20, 60, 80 . . . connecting portion, 21, 61, 81 . . . body portion (of the manipulative lever 16, 56 or 76), 22*a*, 22*b*, 62*a*, 62*b*, 82*a*, 82*b* . . . end portion (of the manipulative lever 16, 56 or 76), 23*a*, 23*b*, 63*a*, 63*b*, 83*a*, 83*b* . . . elongated portion, 24*a*, 24*b*, 64*a*, 64*b*, 84*a*, 84*b* . . . top end portion, 25*a*, 25*b* . . . stepped portion, 30*a*, 30*b* . . . supporting structure, 31*a*, 31*b* . . . resilient holding portion, 32*a*, 32*b* . . . stopper member, 35*a*, 35*b* . . . end portion (of the conductive cover 15), 36*a*, 36*b* . . . restrainer member, 37*a*, 37*b* . . . engaging projection, 40 . . . mating electrical connector, 43 . . . connectively engaging opening, 46*a*, 46*b* . . . engaging aperture, 47*a*, 47*b* . . . grounding terminal, 48*a*, 48*b* . . . resilient engaging portion

MODE MOST PREFERABLE FOR WORKING OF THE INVENTION

A mode most preferable for working of the present invention will be explained with each of embodiments of electrical connector according to the present invention described below.

First Embodiment

Figure 1:
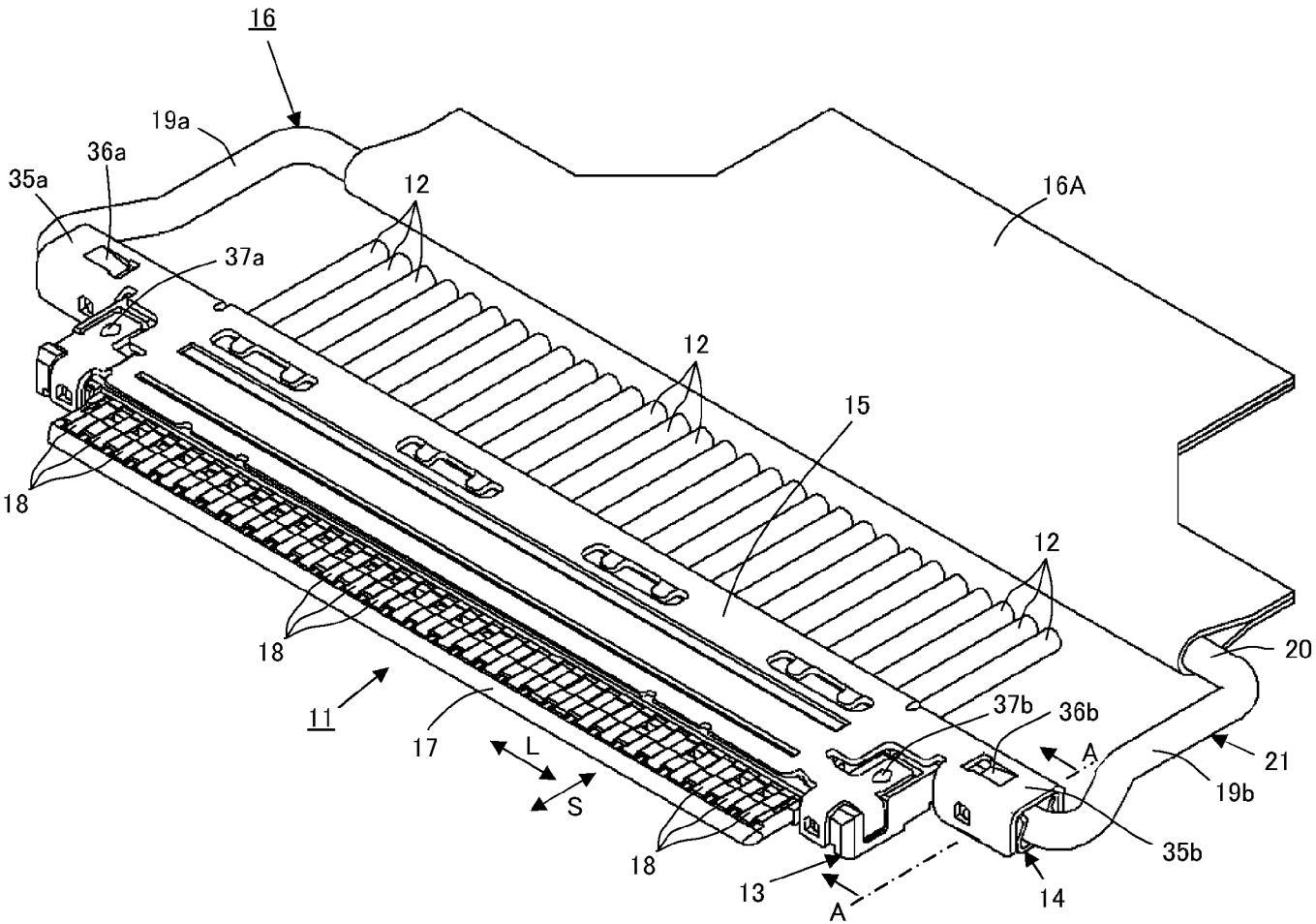
FIG. 1 is a schematic perspective view showing a first embodiment of electrical connector according to the present invention and a plurality of cables connected with the first embodiment.
Figure 2:
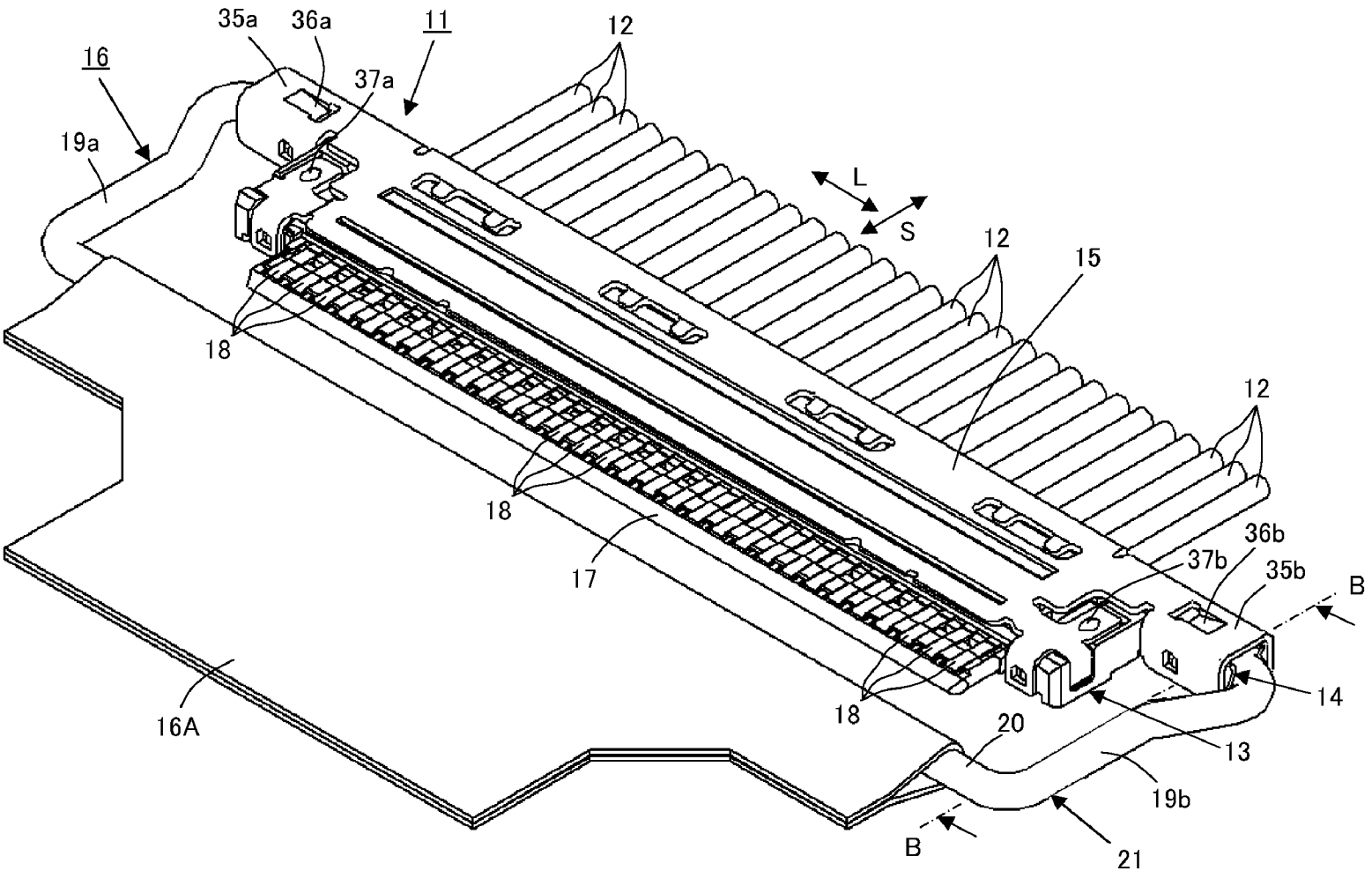
FIG. 2 is a schematic perspective view showing the first embodiment of electrical connector according to the present invention and the cables connected with the first embodiment.

FIGS. 1 and 2 show a first embodiment of electrical connector according to the present invention, together with a plurality of cables connected with the embodiment.

Referring to FIGS. 1 and 2, an electrical connector 11, which constitutes the first embodiment of electrical connector according to the present invention, is used as an electrical connector on the side of cables, with which coaxial cables 12 are electrically connected and which is put in engagement with a mating electrical connector constituting an electrical connector on the side of a circuit board, which is fixed to, for example, a solid printed circuit board so as to be connected electrically with an electric circuit portion provided on the solid printed circuit board. The electrical connector 11 comprises an insulated housing 13 made of insulator such as plastics or the like, a conductive shell 14 and a conductive cover 15 covering partially an outside surface of the insulated housing 13, each of which is formed by means of processing a resilient metal thin plate and grounded to be operative to shield the electrical connector 11 from electromagnetic wave noises coming from the outside, and a manipulative lever 16 provided to be rotatable in respect to the insulated housing 13, which is formed by means of bending a metallic bar member.

The insulated housing 13 is provided thereon with a first engaging portion forming a connectively engaging protrusion 17 which elongates in a longitudinal direction of the insulated housing 13 (which is indicated with arrow L in FIGS. 1 and 2, and hereinafter, referred to an L direction) and is operative to be put in engagement with a second engaging portion forming a connectively engaging opening provided in the mating electrical contact (the electrical connector on the side of a circuit board). Further, the insulated housing 13 is also provided thereon with a plurality of conductive contacts 18 each formed by means of bending a resilient metallic strip member. The conductive contacts 18 have respectively portions thereof arranged in the L direction on the connectively engaging protrusion 17.

When the connectively engaging protrusion 17 is put in engagement with the connectively engaging opening provided in the mating electrical contact, the portion of each of the conductive contacts 18 provided on the connectively engaging protrusion 17 comes into contact with a corresponding one of a plurality of conductive contacts which are provided in the mating electrical connector with portions thereof connected electrically with the solid circuit board to which the mating electrical connector is fixed so that the conductive contacts 18 are in contact with the conductive contacts provided in the mating electrical connector. Further, each of the conductive contacts 18 is connected with a signal conductor 12A of a corresponding one of the coaxial cables 12. Each of the coaxial cables 12 is connected electrically with the electrical connector 11 with the signal conductor 12A thereof connected with the conductive contact 18 and a grounding conductor 12B thereof put in contact with the conductive shell 14 and the conductive cover 15.

Figure 3:
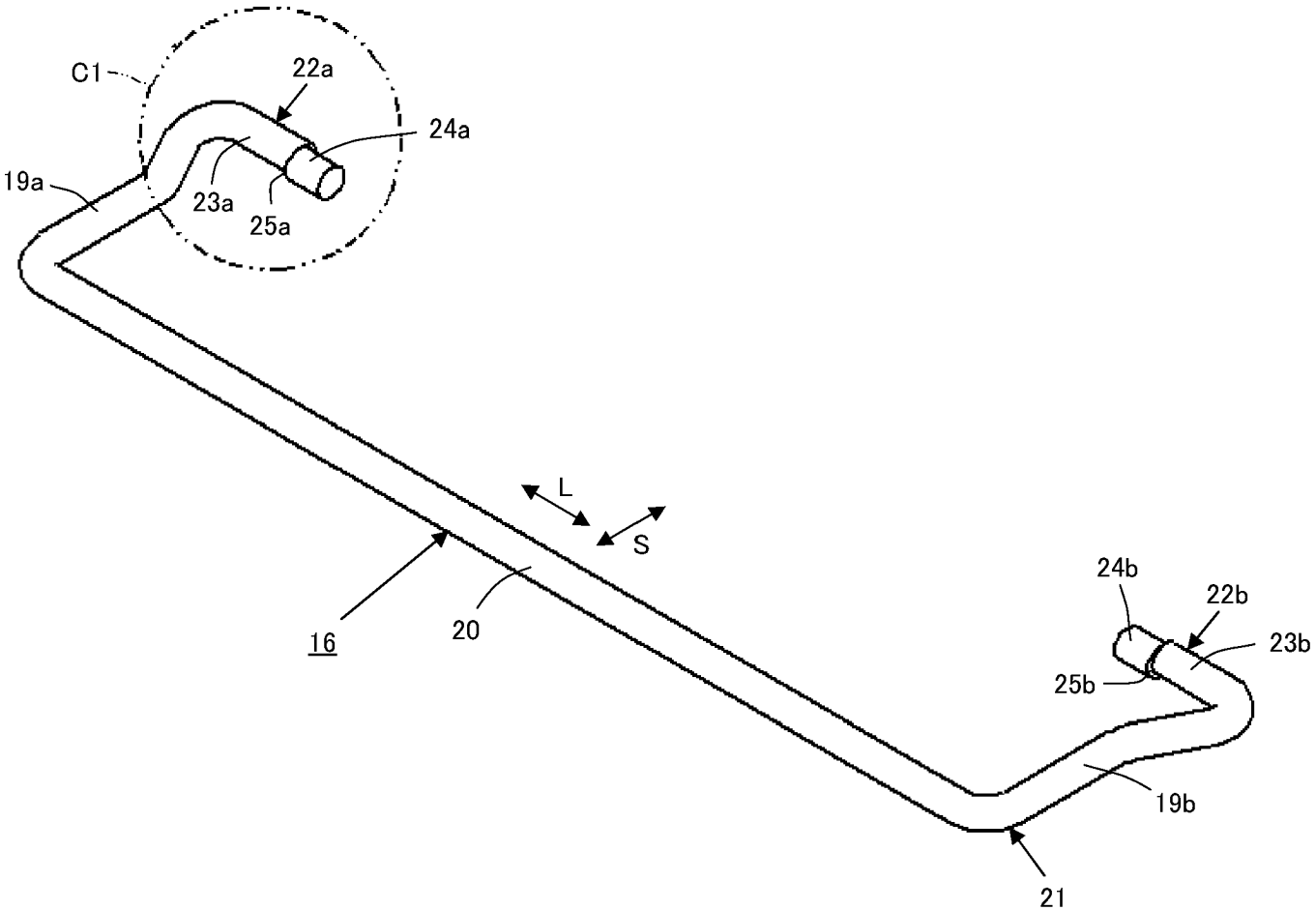
FIG. 3 is a schematic perspective view showing alone a manipulative lever provided to be mounted on the first embodiment shown in FIGS. 1 and 2.

The manipulative lever 16, as shown alone in FIG. 3, has a body portion 21 constituted with a connecting portion 20 elongating in the L direction and a pair of curved arm portions 19*a* and 19*b* connected with each other through the connecting portion 20 and a pair of end portions 22*a* and 22*b* connected respectively with both ends of the body portion 21. The end portion 22*a* comprises an elongated portion 23*a* stretching to be bent from the curved arm portion 19*a* provided at one end of the body portion 21 and a top end portion 24*a* stretching further from the elongated portion 23*a* so as to extending as a whole in the L direction. Similarly, the end portion 22*b* comprises an elongated portion 23*b* stretching to be bent from the curved arm portion 19*b* provided at the other end of the body portion 21 and a top end portion 24*b* stretching further from the elongated portion 23*b* so as to extending as a whole in the L direction.

Figure 4:
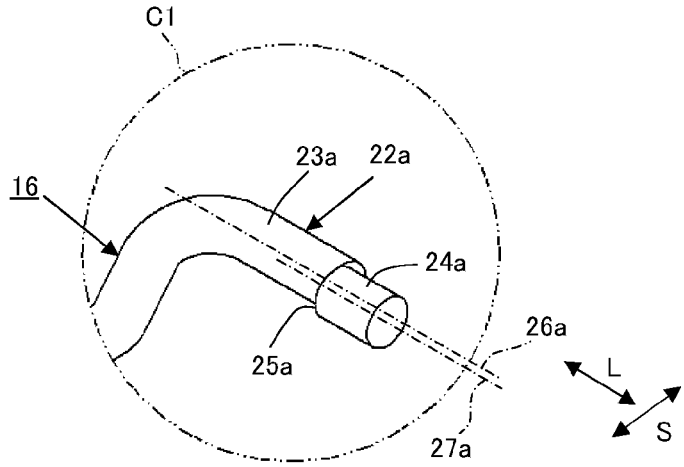
FIG. 4 is a schematic enlarged perspective view showing a part of the manipulative lever surrounded by a circle C1 in FIG. 3.

As shown in FIG. 4 showing a part of the manipulative lever 16 including the end portion 22*a* thereof and surrounded by a circle C1 in FIG. 3, the top end portion 24*a* of the end portion 22*a* protrudes from the elongated portion 23*a* of the end portion 22*a* in a direction perpendicular to an imaginary central axis 26*a* of the elongated portion 23*a* so as to form a stepped portion 25*a* between the elongated portion 23*a* and the top end portion 24*a*, so that an imaginary central axis 27*a* of the top end portion 24*a* is in parallel with the imaginary central axis 26*a* of the elongated portion 23*a*. Since the imaginary central axis 26*a* of the elongated portion 23*a* extends in the L direction, the imaginary central axis 27*a* of the top end portion 24*a* extends also in the L direction to take a position shifted in parallel with the imaginary central axis 26*a* of the elongated portion 23*a* in a direction perpendicular to the L direction (which is indicated with arrow S in FIG. 4, and hereinafter, referred to an S direction).

Similarly, the top end portion 24*b* of the end portion 22*b* protrudes from the elongated portion 23*b* of the end portion 22*b* in a direction perpendicular to an imaginary central axis of the elongated portion 23*b* so as to form a stepped portion 25*b* between the elongated portion 23*b* and the top end portion 24*b*, so that an imaginary central axis of the top end portion 24*b* is in parallel with the imaginary central axis of the elongated portion 23*b*. Since the imaginary central axis of the elongated portion 23*b* extends in the L direction, the imaginary central axis of the top end portion 24*b* extends also in the L direction to take a position shifted in parallel with the imaginary central axis of the elongated portion 23*b* in the S direction perpendicular to the L direction.

The manipulative lever 16 thus constituted is attached to the conductive shell 14, as shown in FIGS. 1 and 2, with the end portion 22*a* thereof comprising the elongated portion 23*a* and the top end portion 24*a* and supported to be rotatable by one of end portions in the L direction of the conductive shell 14 and with the end portion 22*b* thereof comprising the elongated portion 23*b* and the top end portion 24*b* and supported to be rotatable by the other of end portions in the L direction of the conductive shell 14. The end portion 22*a* of the manipulative lever 16 extends as a whole in a direction from one of end portions to a central portion of the insulated housing 13 along the L direction and the end portion 22*b* of the manipulative lever 16 extends as a whole in a direction from the other of the end portions to the central portion of the insulated housing 13 along the L direction, so that the top end portions 24*a* and 24*b* of the manipulative lever 16 are opposite to each other in the L direction. Thereby, the manipulative lever 16 is provided on the electrical connector 11 to be rotatable in respect to the insulated housing 13. Further, a manipulative tag 16A with which the manipulative lever 16 is easily manipulated to rotate is attached to the connecting portion 20 constituting the body portion 21 of the manipulative lever 16.

As shown in FIGS. 1 and 2, the conductive shell 14 covers partially a lower outside surface (a bottom surface) of the insulated housing 13 and the conductive cover 15 covers partially an upper outside surface (a top surface) of the insulated housing 13. Then, as shown in FIG. 5 showing the electrical connector 11 without the conductive cover 15 mounted on the insulated housing 13, together with the coaxial cables 12 connected electrically with electrical connector 11, a pair of supporting structures 30*a* and 30*b* are provided respectively at the end portions in the L direction of the conductive shell 14 for supporting respectively the end portions 22*a* and 22*b* of the manipulative lever 16 to be rotatable.

Figure 5:
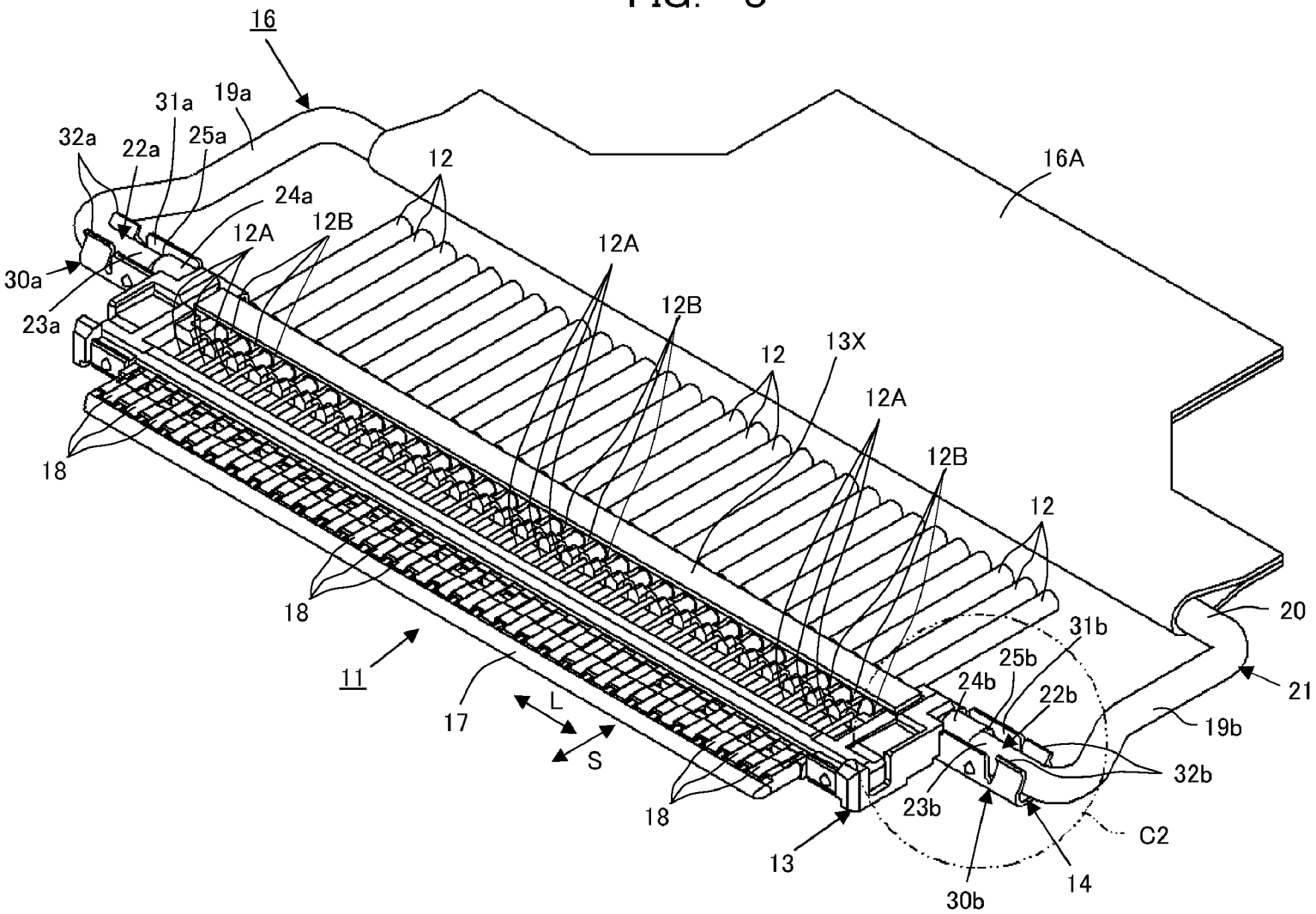
FIG. 5 is a schematic perspective view showing the first embodiment shown in FIG. 1 without a conductive cover mounted on an insulated housing thereon.

As shown in FIG. 5, the signal conductor 12A and the grounding conductor 12B of each of the coaxial cables 12 are electrically connected respectively with the conductive contact 18 and a common grounding conductor 13X. The common grounding conductor 13X is put in contact with the conductive shell 14 and the conductive cover 15.

The supporting structure 30*a* is provided with a resilient holding portion 31*a* for holding the end portion 22*a* comprising the elongated portion 23*a* and the top end portion 24*a* of the manipulative lever 16 and the supporting structure 30*b* is provided with a resilient holding portion 31*b* for holding the end portion 22*b* comprising the elongated portion 23*b* and the top end portion 24*b* of the manipulative lever 16. Since each of the end portions 22*a* and 22*b* of the manipulative lever 16 extends as a whole in the direction from the end portion to the central portion of the insulated housing 13 along the L direction, each of the resilient holding portions 31*a* and 31*b* provided respectively in the supporting structures 30*a* and 30*b* elongate also along the L direction so as to hold the end portion 22*a* or 22*b*. The manipulative lever 16 is able to be rotated in respect to the insulated housing 13 on an imaginary rotating axis passing through the end portions 22*a* and 22*b* thereof held respectively by the resilient holding portions 31*a* and 31*b* so as to take up selectively a first station wherein the body portion 21 of the manipulative lever 16 is put on the side of the coaxial cables 12 connected electrically with the electrical connector 11, as shown in FIG. 1, and a second station wherein the body portion 21 of the manipulative lever 16 is put on the side of the connectively engaging protrusion 17 provided on the insulated housing 13, as shown in FIG. 2.

Further, the supporting structure 30*a* is also provided with a stopper member 32*a* for engaging with the stepped portion 25*a* formed on the end portion 22*a* of the manipulative lever 16 so as to restrain movements of the end portion 22*a* in the L direction and the supporting structure 30*b* is also provided with a stopper member 32*b* for engaging with the stepped portion 25*b* formed on the end portion 22*b* of the manipulative lever 16 so as to restrain movements of the end portion 22*b* in the L direction.

Figure 6:
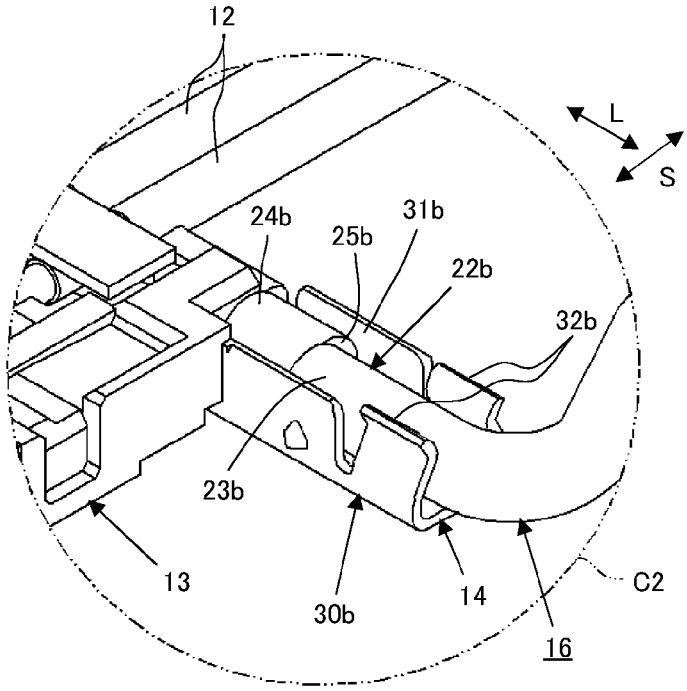
FIG. 6 is a schematic enlarged perspective view showing a part of the first embodiment surrounded by a circle C2 in FIG. 5.

As shown in FIG. 6 showing a part of the electrical connector 11 surrounded by a circle C2 in FIG. 5, which includes the end portion 22*b* of the manipulative lever 16 and the supporting structure 30*b* provided at the end portion of the conductive shell 14, the resilient holding portion 31*b* provided in the supporting structure 30*b* is shaped into a groove-like portion elongating in the L direction, in which a part of the end portion 22*b* of the manipulative lever 16 including the elongated portion 23*b*, the top end portion 24*b* and the stepped portion 25*b* is put to be rotatable, and the stopper member 32*b* provided in the supporting structure 30*b* is shaped into a pair of curved wall portions facing each other in the S direction with the elongated portion 23*b* constituting the end portion 22*b* of the manipulative lever 16 between. The groove-like portion formed by the resilient holding portion 31*b* provided in the supporting structure 30*b* is operative to fix the part of the end portion 22*b* of the manipulative lever 16 including the elongated portion 23*b*, the top end portion 24*b* and the stepped portion 25*b* in the S direction. Each of the curved wall portions formed by the stopper member 32*b* provided in the supporting structure 30*b* has an end surface close to the resilient holding portion 31*b* and operative to engage with the stepped portion 25*b* at the end portion 22*b* of the manipulative lever 16.

Similarly, the resilient holding portion 31*a* provided in the supporting structure 30*a* is shaped into a groove-like portion elongating in the L direction, in which a part of the end portion 22*a* of the manipulative lever 16 including the elongated portion 23*a*, the top end portion 24*a* and the stepped portion 25*a* is put to be rotatable, and the stopper member 32*a* provided in the supporting structure 30*a* is shaped into a pair of curved wall portions facing each other in the S direction with the elongated portion 23*a* constituting the end portion 22*a* of the manipulative lever 16 between. The groove-like portion formed by the resilient holding portion 31*a* provided in the supporting structure 30*a* is operative to fix the part of the end portion 22*a* of the manipulative lever 16 including the elongated portion 23*a*, the top end portion 24*a* and the stepped portion 25*a* in the S direction. Each of the curved wall portions formed by the stopper member 32*a* provided in the supporting structure 30*a* has an end surface close to the resilient holding portion 31*a* and operative to engage with the stepped portion 25*a* at the end portion 22*a* of the manipulative lever 16.

When the conductive cover 15 is mounted on the insulated housing 13 to cover partially the top surface of the insulated housing 13 as shown in FIGS. 1 and 2, both end portions 35*a* and 35*b* in the L direction of the conductive cover 15 are operative to cover respectively the supporting structure 30*a* and 30*b* provided at the end portions in the L direction of the conductive shell 14 for supporting respectively the end portions 22*a* and 22*b* of the manipulative lever 16 to be rotatable. A restrainer member 36*a* is provided in the end portion 35*a* of the conductive cover 15. This restrainer member 36*a* is operative to come into contact with the end portion 22*a* of the manipulative lever 16 for restraining the same when the end portion 35*a* of the conductive cover 15 covers the supporting structure 30*a*. Similarly, a restrainer member 36*b* is provided in the end portion 35*b* of the conductive cover 15. This restrainer member 36*b* is operative to come into contact with the end portion 22*b* of the manipulative lever 16 for restraining the same when the end portion 35*b* of the conductive cover 15 covers the supporting structure 30*b*. With the end portions 35*a* and 35*b* of the conductive cover 15 thus covering respectively the supporting structures 30*a* and 30*b*, dust or dirt is prevented from entering into the resilient holding portion 31*a* and the stopper member 32*a* provided in the supporting structure 30*a* and into the resilient holding portion 31*b* and the stopper member 32*b* provided in the supporting structure 30*b*.

Further, engaging projections 37*a* and 37*b* are provide respectively on resilient cantilever portions of the conductive cover 15 in close vicinity to the end portions 35*a* and 35*b* of the same. Each of the engaging projections 37*a* and 37*b* is operative to engage resiliently with an engaging aperture formed in a conductive shell of the mating electrical connector when the conductively engaging protrusion 17 provided on the housing 13 engages with the connectively engaging opening provided on the mating electrical connector and to disengage resiliently from the engaging aperture formed in the conductive shell of the mating electrical connector when the connectively engaging protrusion 17 provided on the insulated housing 13 gets out of the connectively engaging opening provided on the mating electrical connector.

Under such a condition as mentioned above, the resilient holding portion 31*a* of the supporting structure 30*a* provided at the end portion of the conductive shell 14 is operative to hold the end portion 22*a* of the manipulative lever 16 comprising the elongated portion 23*a* and the top end portion 24*a* thereof and put in the groove-like portion formed by the resilient holding portion 31*a* in such a manner that the top end portion 24*a* is allowed to shift its position in the S direction in response to the rotary movement of the manipulative lever 16. Similarly, the resilient holding portion 31*b* of the supporting structure 30*b* provided at the end portion of the conductive shell 14 is operative to hold the end portion 22*b* of the manipulative lever 16 comprising the elongated portion 23*b* and the top end portion 24*b* thereof and put in the groove-like portion formed by the resilient holding portion 31*b* in such a manner that the top end portion 24*b* is allowed to shift its position in the S direction in response to the rotary movement of the manipulative lever 16.

Figure 7:
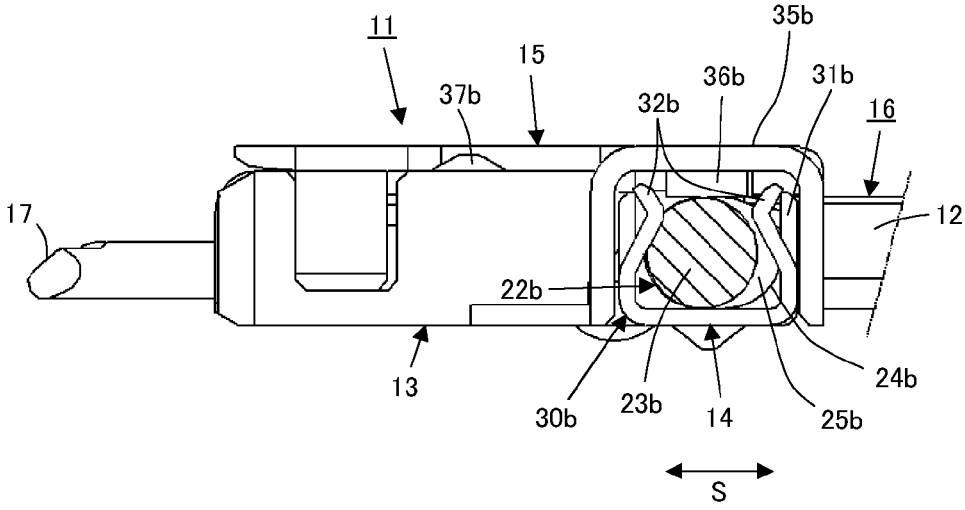
FIG. 7 is a schematic cross sectional view taken along line A-A in FIG. 1.

When the manipulative lever 16 is rotated in respect to the insulated housing 13 so that the body portion 21 of the manipulative lever 16 is put on the side of the coaxial cables 12 connected electrically with the electrical connector 11 as shown in FIG. 1, in the groove-like portion formed by the resilient holding portion 31*b* of the supporting structure 30*b* provided at the end portion of the conductive shell 14, the top end portion 24*b* constituting the end portion 22*b* of the manipulative lever 16 is put in such a condition as to project in the S direction from the elongated portion 23*b* constituting the end portion 22*b* of the manipulative lever 16 toward the coaxial cables 12 as shown in FIG. 7 showing a cross section taken along line A-A in FIG. 1. Accordingly, in the groove-like portion formed by the resilient holding portion 31*b* of the supporting structure 30*b*, the elongated portion 23*b* is positioned on the side of the connectively engaging protrusion 17 provided on the insulated housing 13 in the S direction and the top end portion 24*b* is positioned on the side of the coaxial cables 12 in the S direction.

Then, when an external force acts on the manipulative lever 16 so as to move the end portion 22*b* of the manipulative lever 16 in the L direction toward the outside of the insulated housing 13, the end surface close to the resilient holding portion 31*b* of the stopper member 32*b* provided in the supporting structure 30*b* engages with the stepped portion 25*b* formed by the top end portion 24*b* constituting the end portion 22*b* of the manipulative lever 16 to restrain movements of the same. Thereby, the end portion 22*b* of the manipulative lever 16 is surely prevented from getting out of the supporting structure 30*b*.

Further, in the groove-like portion formed by the resilient holding portion 31*a* of the supporting structure 30*a* provided at the end portion of the conductive shell 14, the top end portion 24*a* constituting the end portion 22*a* of the manipulative lever 16 is put in such a condition as to project in the S direction from the elongated portion 23*a* constituting the end portion 22*a* of the manipulative lever 16 toward the coaxial cables 12. Accordingly, in the groove-like portion formed by the resilient holding portion 31*a* of the supporting structure 30*a*, the elongated portion 23*a* is positioned on the side of the connectively engaging protrusion 17 provided on the insulated housing 13 in the S direction and the top end portion 24*a* is positioned on the side of the coaxial cables 12 in the S direction.

Then, when an external force acts on the manipulative lever 16 so as to move the end portion 22*a* of the manipulative lever 16 in the L direction toward the outside of the insulated housing 13, the end surface close to the resilient holding portion 31*a* of the stopper member 32*a* provided in the supporting structure 30*a* engages with the stepped portion 25*a* formed by the top end portion 24*a* constituting the end portion 22*a* of the manipulative lever 16 to restrain movements of the same. Thereby, the end portion 22*a* of the manipulative lever 16 is surely prevented from getting out of the supporting structure 30*a*.

Figure 8:
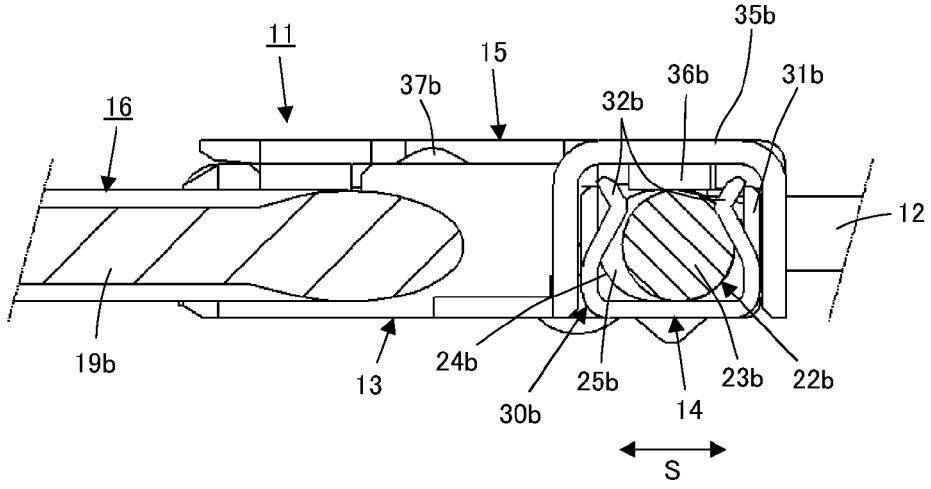
FIG. 8 is a schematic cross sectional view taken along line B-B in FIG. 2.

On the other hand, when the manipulative lever 16 is rotated in respect to the insulated housing 13 so that the body portion 21 of the manipulative lever 16 is put on the side of the connectively engaging protrusion 17 provided on the insulated housing 13 as shown in FIG. 2, in the groove-like portion formed by the resilient holding portion 31*b* of the supporting structure 30*b* provided at the end portion of the conductive shell 14, the top end portion 24*b* constituting the end portion 22*b* of the manipulative lever 16 is put in such a condition as to project in the S direction from the elongated portion 23*b* constituting the end portion 22*b* of the manipulative lever 16 toward the connectively engaging protrusion 17 provided on the insulated housing 13 (which is opposite to the coaxial cables 12) as shown in FIG. 8 showing cross sections taken along line B-B in FIG. 2. Accordingly, in the groove-like portion formed by the resilient holding portion 31*b* of the supporting structure 30*b*, the elongated portion 23*b* is positioned on the side of the coaxial cables 12 in the S direction and the top end portion 24*b* is positioned on the side of the connectively engaging protrusion 17 provided on the insulated housing 13 in the S direction.

Then, when an external force acts on the manipulative lever 16 so as to move the end portion 22*b* of the manipulative lever 16 in the L direction toward the outside of the insulated housing 13, the end surface close to the resilient holding portion 31*b* of the stopper member 32*b* provided in the supporting structure 30*b* engages with the stepped portion 25*b* formed by the top end portion 24*b* constituting the end portion 22*b* of the manipulative lever 16 to restrain movements of the same. Thereby, the end portion 22*b* of the manipulative lever 16 is surely prevented from getting out of the supporting structure 30*b*.

Further, in the groove-like portion formed by the resilient holding portion 31*a* of the supporting structure 30*a* provided at the end portion of the conductive shell 14, the top end portion 24*a* constituting the end portion 22*a* of the manipulative lever 16 is put in such a condition as to project in the S direction from the elongated portion 23*a* constituting the end portion 22*a* of the manipulative lever 16 toward the connectively engaging protrusion 17 provided on the insulated housing 13 (which is opposite to the coaxial cables 12). Accordingly, in the groove-like portion formed by the resilient holding portion 31*a* of the supporting structure 30*a*, the elongated portion 23*a* is positioned on the side of the coaxial cables 12 in the S direction and the top end portion 24*a* is positioned on the side of the connectively engaging protrusion 17 provided on the insulated housing 13 in the S direction.

Then, when an external force acts on the manipulative lever 16 so as to move the end portion 22*a* of the manipulative lever 16 in the L direction toward the outside of the insulated housing 13, the end surface close to the resilient holding portion 31*a* of the stopper member 32*a* provided in the supporting structure 30*a* engages with the stepped portion 25*a* formed by the top end portion 24*a* constituting the end portion 22*a* of the manipulative lever 16 to restrain movements of the same. Thereby, the end portion 22*a* of the manipulative lever 16 is surely prevented from getting out of the supporting structure 30*a*.

In addition, in the case where the manipulative lever 16 is rotated in respect to the insulated housing 13 so that the body portion 21 of the manipulative lever 16 is located at a position between the position on the side of the coaxial cables 12 as shown in FIG. 1 and the position on the side of the connectively engaging protrusion 17 provided on the insulated housing 13 as shown in FIG. 2 and an external force acts on the manipulative lever 16 so as to move the end portion 22*a* or 22*b* of the manipulative lever 16 in the L direction toward the outside of the insulated housing 13, the end surface close to the resilient holding portion 31*a* of the stopper member 32*a* provided in the supporting structure 30*a* engages with the stepped portion 25*a* formed by the top end portion 24*a* constituting the end portion 22*a* of the manipulative lever 16 to restrain movements of the same, or the end surface close to the resilient holding portion 31*b* of the stopper member 32*b* provided in the supporting structure 30*b* engages with the stepped portion 25*b* formed by the top end portion 24*b* constituting the end portion 22*b* of the manipulative lever 16 to restrain movements of the same. Thereby, the end portions 22*a* and 22*b* of the manipulative lever 16 are surely prevented from getting respectively out of the supporting structures 30*a* and 30*b*.

Figure 9:
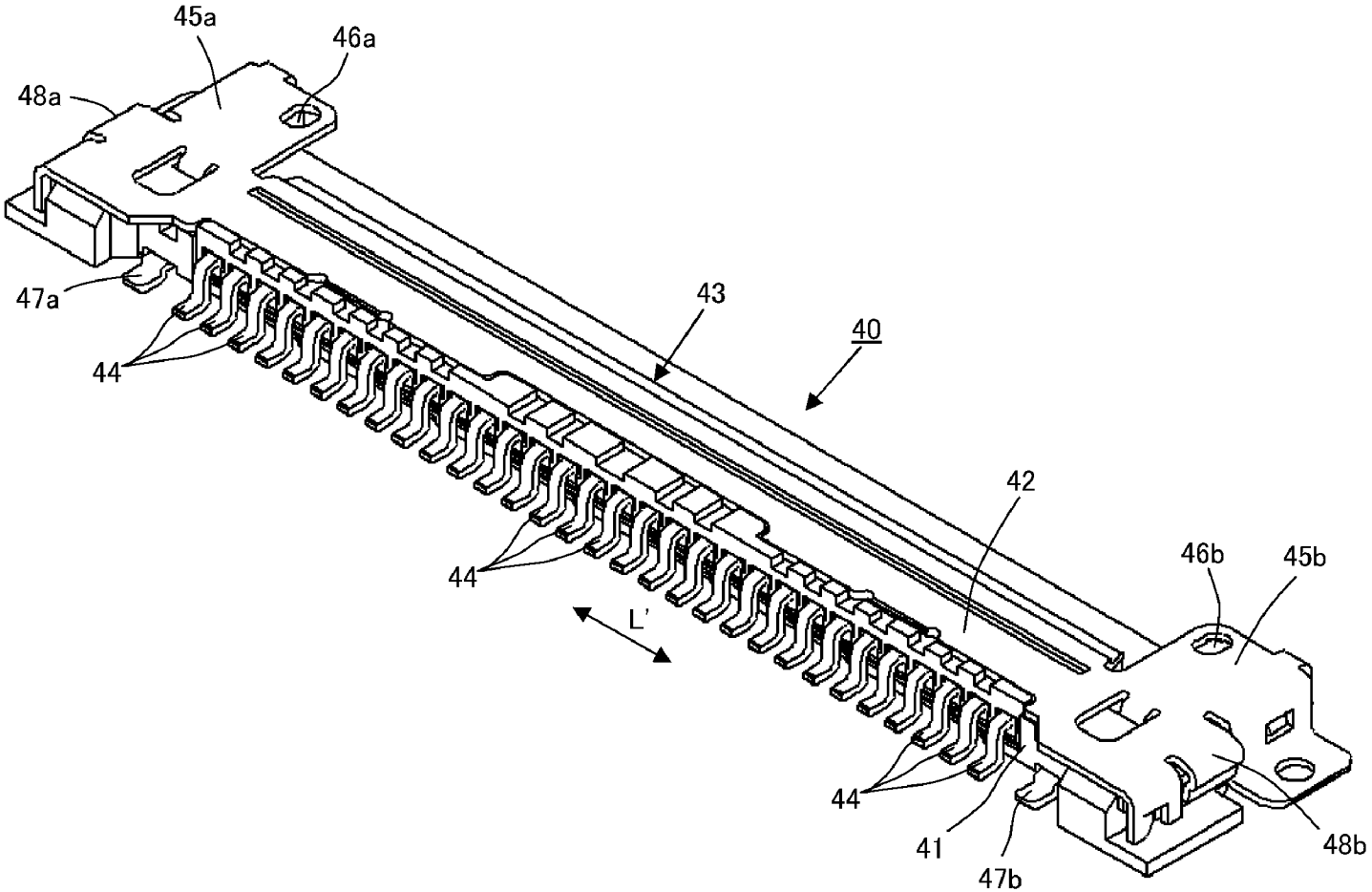
FIG. 9 is a schematic perspective view showing an example of a mating electrical connector mounted on a circuit board, with which the first embodiment shown in FIGS. 1 and 2 engages.
Figure 10:
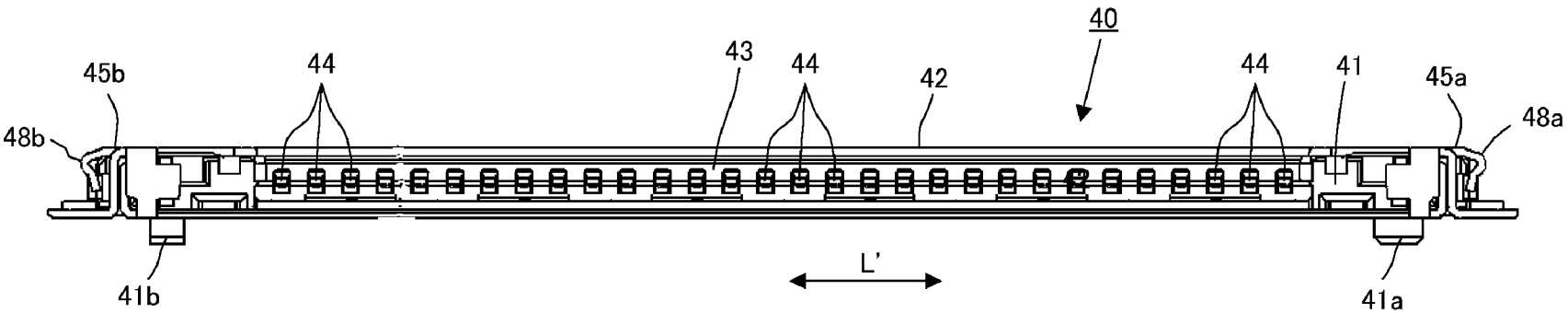
FIG. 10 is a schematic front view showing the example shown in FIG. 9.

FIG. 9 (a schematic perspective view) and FIG. 10 (a schematic front view) show a mating electrical connector 40 with which the electrical connector 11 is put in engagement.

Referring to FIGS. 9 and 10, the mating electrical connector 40 is fixed to the solid printed circuit board (not shown in the drawings) to be electrically connected with the electric circuit portion provided on the solid printed circuit board, so that the electrical connector 11 is put in engagement with the mating electrical connector 40 fixed to the solid printed circuit board. The mating electrical connector 40 comprises an insulated housing 41 made of insulator such as plastics or the like and a conductive shell 42 covering a major portion of an outside surface of the insulated housing 41, which is formed by means of processing a resilient metal thin plate and grounded to be operative to shield the mating electrical connector 40 from electromagnetic wave noises coming from the outside.

The insulated housing 41 of the mating electrical connector 40 is provided with positioning protrusions 41*a* and 41*b*, each of which projects from a lower outside surface thereof to be operative to engage with an engaging aperture provided on the solid printed circuit board on which the mating electrical connector 40 is fixed, as shown in FIG. 10.

On the insulated housing 41 and the conductive shell 42, a connectively engaging opening 43 constituting the second engaging portion is provided to extend in a longitudinal direction of the insulated housing 41 (which is indicated with arrow L' in FIGS. 9 and 10, and hereinafter, referred to an L'direction). Further, the insulated housing 41 is provided thereon with a plurality of conductive contacts 44 each formed by means of bending a resilient metallic strip member. The conductive contacts 44 are arranged in the L'direction on the insulated housing 41. One of end portions of each of the conductive contacts 44 projecting from the insulated housing 41 toward the outside thereof constitutes a connecting terminal operative to be electrically connected with the electric circuit portion provided on the solid printed circuit board on which the mating electrical connector 40 is fixed. The other of the end portions of each of the conductive contacts 44 is located in the connectively engaging opening 43 to constitute a connecting portion, with which a corresponding one of the conductive contacts provided in the electrical connector 11 comes into contact when the connectively engaging protrusion 17 of the electrical connector 11 is engaged with the connectively engaging opening 43.

Engaging apertures 46*a* and 46*b* are provided respectively on end portions 45*a* and 45*b* in the L'direction of the conductive shell 42. The engaging projections 37*a* and 37*b* provided on the conductive cover 15 of the electrical connector 11 are put in engagement respectively with the engaging apertures 46*a* and 46*b* when the connectively engaging protrusion 17 provided on the insulated housing 13 of the electrical connector 11 is engaged with the connectively engaging opening 43 provided on the insulated housing 41 and the conductive shell 42.

The conductive shell 42 is also provided with grounding terminals 47*a* and 47*b* which are located respectively at portions of the conductive shell 42 opposite to each other with conductive contacts 44 between. Each of the grounding terminals 47*a* and 47*b* extends from the insulated housing 41 to the outside thereof so as to be electrically connected with a grounding portion provided on the solid printed circuit board to which the mating electrical connector 40 is fixed.

Further, the end portions 45*a* and 45*b* of the conductive shell 42 are provided respectively with resilient engaging portions 48*a* and 48*b*. The resilient engaging portions 48*a* and 48*b* are operative to engage respectively with the curved arm portions 19*a* and 19*b* of the manipulative lever 16 provided in the electrical connector 11 and manipulated to rotate when the connectively engaging protrusion 17 provided on the insulated housing 13 of the electrical connector 11 is engaged with the connectively engaging opening 43 provided on the insulated housing 41 and the conductive shell 42.

The mating electrical connector 40 thus constituted is fixed to the solid printed circuit board to be electrically connected with the electric circuit portion provided thereon in such a manner that the connecting terminal at the end of each of the conductive contact 44 is electrically connected with a circuit pattern on the solid printed circuit board and the grounding terminals 47*a* and 47*b* are electrically connected with the grounding portion provided on the solid printed circuit board.

Figure 11:
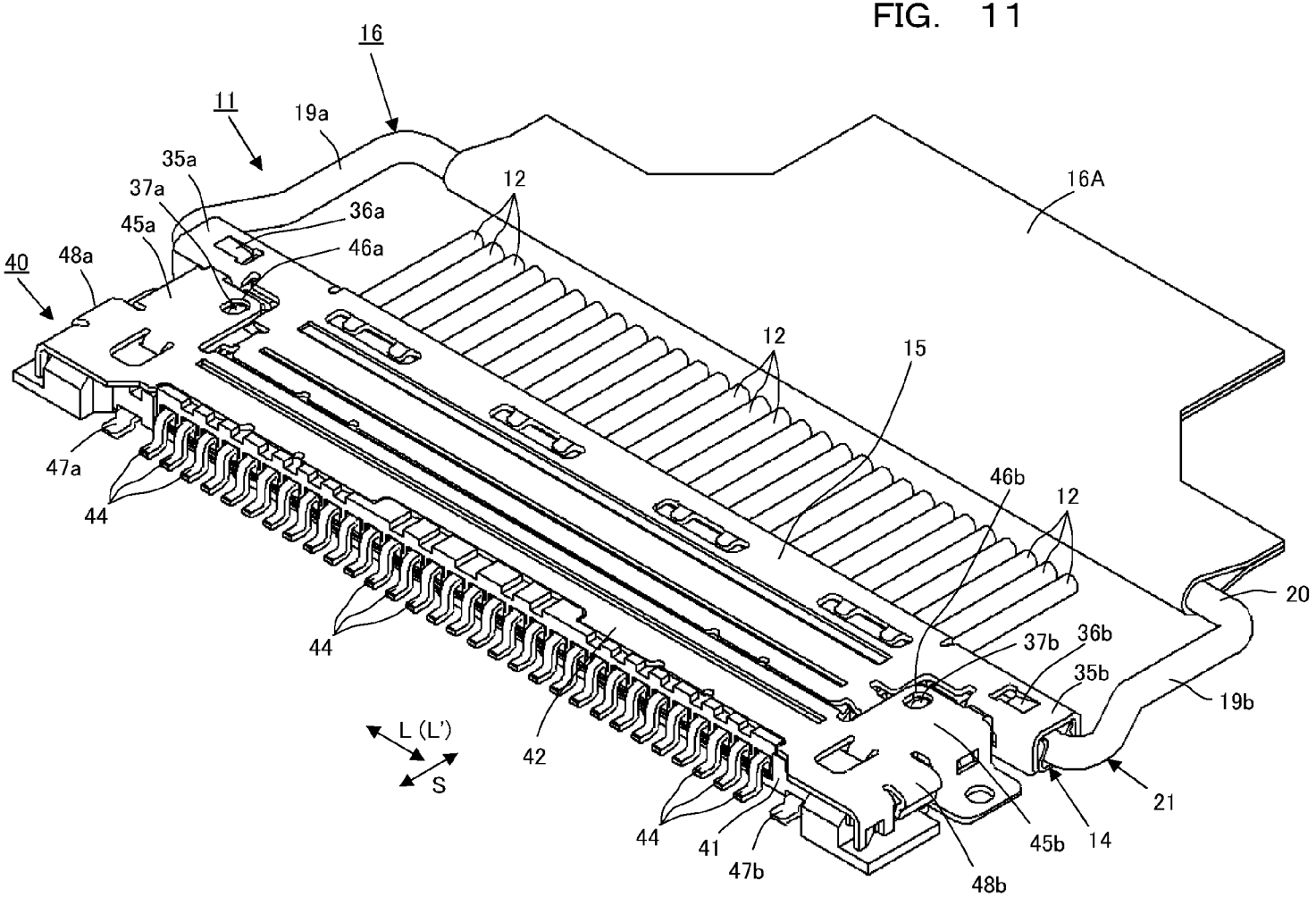
FIG. 11 is a schematic perspective view showing the first embodiment shown in FIG. 1 put in engagement with the example shown in FIGS. 9 and 10.

When the electrical connector 11 is put in engagement with the mating electrical connector 40 fixed to the solid printed circuit board, as shown in FIG. 11, the connectively engaging protrusion 17 provided on the insulated housing 13 of the electrical connector 11, in which the manipulative lever 16 takes up the first station wherein the body portion 21 of the manipulative lever 16 is put on the side of the coaxial cables 12 connected electrically with the electrical connector 11, is inserted in the S direction into the connectively engaging opening 43 provided on the insulated housing 41 and the conductive shell 42 of the mating electrical connector 40 to be engaged with the same.

Under a condition wherein the connectively engaging protrusion 17 provided on the insulated housing 13 of the electrical connector 11 is thus engaged with the connectively engaging opening 43 provided on the insulated housing 41 and the conductive shell 42 of the mating electrical connector 40, the engaging projections 37*a* and 37*b* provided on the conductive cover 15 of the electrical connector 11 are engaged respectively with the engaging apertures 46*a* and 46*b* provided on the conductive shell 42 of the mating electrical connector 40. Thereby, the conductive cover 15 and the conductive shell 42 are put in contact with each other and the connectively engaging protrusion 17 of the electrical connector 11 and the connectively engaging opening 43 of the mating electrical connector 40 are stably maintained in engagement with each other.

Figure 12:
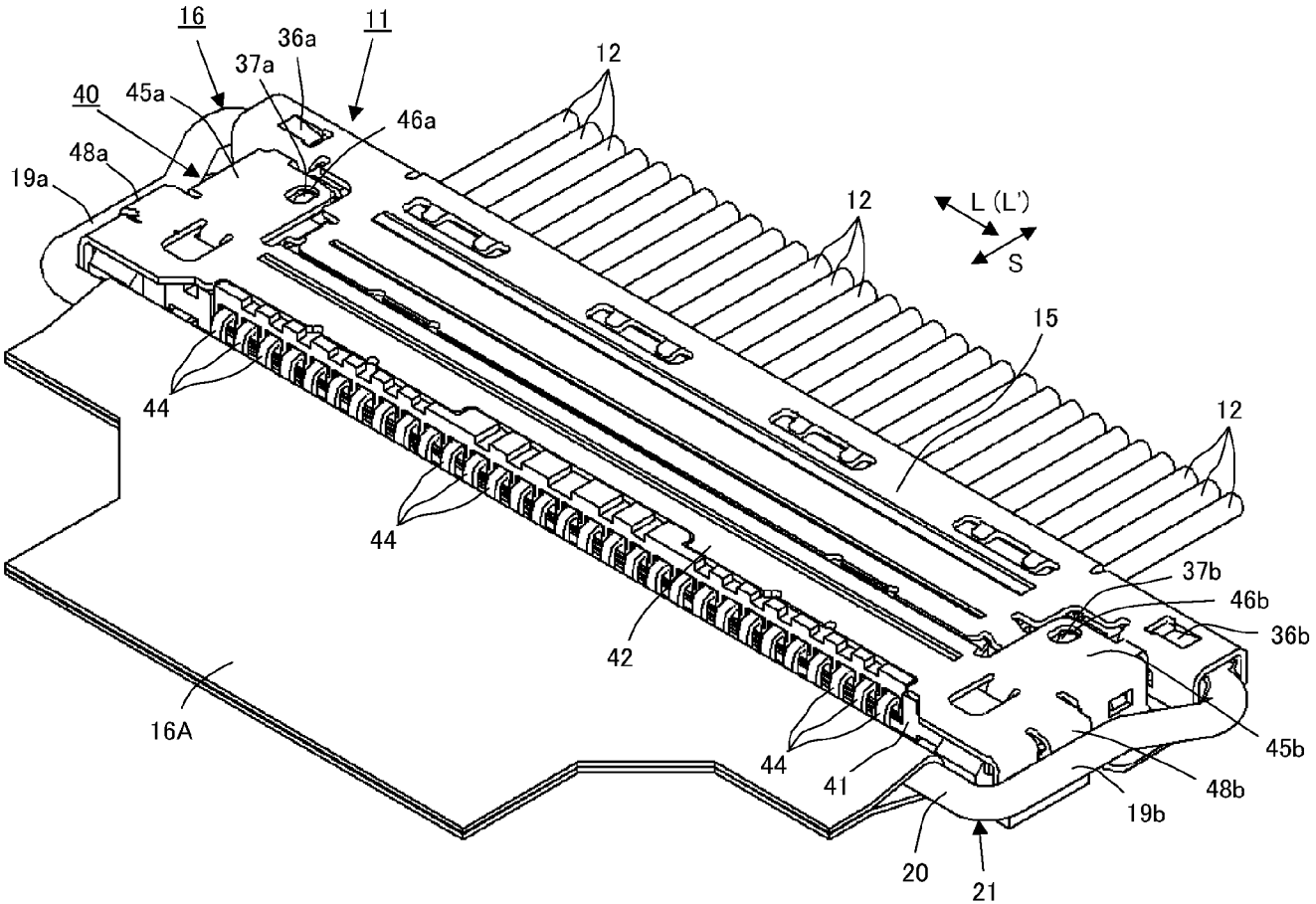
FIG. 12 is a schematic perspective view showing the first embodiment shown in FIG. 1 put in engagement with the example shown in FIGS. 9 and 10.

Then, the manipulative lever 16 provided in the electrical connector 11 is manipulated to rotate from the first station wherein the body portion 21 of the manipulative lever 16 is put on the side of the coaxial cables 12 connected electrically with the electrical connector 11 to the second station wherein the body portion 21 of the manipulative lever 16 is put on the side of the connectively engaging protrusion 17 provided on the insulated housing 13 of the electrical connector 11, as shown in FIG. 12.

When the manipulative lever 16 provided in the electrical connector 11 takes up the second station shown in FIG. 12, the curved arm portions 19*a* and 19*b* of the manipulative lever 16 are caused to ride respectively across protrusions on the resilient engaging portions 48*a* and 48*b* provided on the conductive shell 42 of the mating electrical connector 40 so as to engage with the resilient engaging portions 48*a* and 48*b*. Thereby, the manipulative lever 16 is stationed on the mating electrical connector 40.

Under a condition wherein the curved arm portions 19*a* and 19*b* of the manipulative lever 16 are put respectively in engagement with the resilient engaging portions 48*a* and 48*b* provided on the conductive shell 42 of the mating electrical connector 40, the body portion 21 of the manipulative lever 16 is put on the side of the connectively engaging protrusion 17 provided on the insulated housing 13 of the electrical connector 11. Accordingly, as described above with reference to FIG. 8, in the groove-like portion formed by the resilient holding portion 31*b* of the supporting structure 30*b* provided at the end portion of the conductive shell 14 of the electrical connector 11, the elongated portion 23*b* is positioned on the side of the coaxial cables 12 in the S direction and the top end portion 24*b* is positioned on the side of the connectively engaging protrusion 17 provided on the insulated housing 13 in the S direction, and in the groove-like portion formed by the resilient holding portion 31*a* of the supporting structure 30*a* provided at the end portion of the conductive shell 14 of the electrical connector 11, the elongated portion 23*a* is positioned on the side of the coaxial cables 12 in the S direction and the top end portion 24*a* is positioned on the side of the connectively engaging protrusion 17 provided on the insulated housing 13 in the S direction.

Accordingly, the end portion 22*a* of the manipulative lever 16 is pressed resiliently by the resilient holding portion 31*a* of the supporting structure 30*a* toward the coaxial cables 12 connected electrically with the electrical connector 11 in the S direction and simultaneously the end portion 22*b* of the manipulative lever 16 is also pressed resiliently by the resilient holding portion 31*b* of the supporting structure 30*b* toward the coaxial cables 12 connected electrically with the electrical connector 11 in the S direction, so that the body portion 21 of the manipulative lever 16 constituted with the curved arm portions 19*a* and 19*b* and the connecting portion 20 is forced to move toward the coaxial cables 12 in the S direction. That is, the elongated portion 23*a* and the top end portion 24*a* constituting the end portion 22*a* of the manipulative lever 16 supported by the supporting structure 30*a* and the elongated portion 23*b* and the top end portion 24*b* constituting the end portion 22*b* of the manipulative lever 16 supported by the supporting structure 30*a* are operative to exert on the manipulative lever 16 having the curved arm portions 19*a* and 19*b* engaged respectively with the resilient engaging portions 48*a* and 48*b* such resilient force as to move the body portion 21 of the manipulative lever 16 toward the coaxial cables 12 connected electrically with the electrical connector 11 in the S direction.

With the resilient force thus caused to act on the manipulative lever 16 by the end portions 22*a* and 22*b* of the manipulative lever 16, the body portion 21 of the manipulative lever 16 having the curved arm portions 19*a* and 19*b* engaged respectively with the resilient engaging portions 48*a* and 48*b* is pressed against the mating electrical connector 40. Accordingly, the elongated portion 23*a* and the top end portion 24*a* constituting the end portion 22*a* of the manipulative lever 16 supported by the supporting structure 30*a* and the elongated portion 23*b* and the top end portion 24*b* constituting the end portion 22*b* of the manipulative lever 16 supported by the supporting structure 30*b* are operative to exert, on the manipulative lever 16 having the curved arm portions 19*a* and 19*b* engaged respectively with the resilient engaging portions 48*a* and 48*b*, the resilient force for pressing the body portion 21 of the manipulative lever 16 against the mating electrical connector 40.

With the body portion 21 of the manipulative lever 16 thus pressed against the mating electrical connector 40 by the resilient force brought about by the end portions 22*a* and 22*b* of the manipulative lever 16, an undesirable condition wherein a vacant space is formed between the manipulative lever 16 having the curved arm portions 19*a* and 19*b* engaged respectively with the resilient engaging portions 48*a* and 48 provided on the conductive shell 42 of the mating electrical connector 40 and the mating electrical connector 40 and thereby the manipulative lever 16 comes to unsteadiness so as to produce an undesirable noise, can be surely avoided.

Even under the condition wherein the electrical connector 11 is put in engagement with the mating electrical connector 40, as described above, when an external force acts on the manipulative lever 16 so as to move the end portion 22*a* of the manipulative lever 16 in the L direction toward the outside of the insulated housing 13, the end surface close to the resilient holding portion 31*a* of the stopper member 32*a* provided in the supporting structure 30*a* engages with the stepped portion 25*a* formed by the top end portion 24*a* constituting the end portion 22*a* of the manipulative lever 16 to restrain movements of the same, so that the end portion 22*a* of the manipulative lever 16 is surely prevented from getting out of the supporting structure 30*a*, and similarly, when an external force acts on the manipulative lever 16 so as to move the end portion 22*b* of the manipulative lever 16 in the L direction toward the outside of the insulated housing 13, the end surface close to the resilient holding portion 31*b* of the stopper member 32*b* provided in the supporting structure 30*b* engages with the stepped portion 25*b* formed by the top end portion 24*b* constituting the end portion 22*b* of the manipulative lever 16 to restrain movements of the same, and thereby, the end portion 22*b* of the manipulative lever 16 is surely prevented from getting out of the supporting structure 30*b*.

In such a manner as described above, with the manipulative lever 16 taking up the second station as shown in FIG. 12, the condition wherein the connectively engaging protrusion 17 provided on the insulated housing 13 of the electrical connector 11 is engaged with the conductive engaging opening 43 provided on the insulated housing 41 and the conductive shell 42 of the mating electrical connector 40 is more surely and stably maintained.

After that, when the connectively engaging protrusion 17 provided on the insulated housing 13 of the electrical connector 11 is disengaged from the conductive engaging opening 43 provided on the insulated housing 41 and the conductive shell 42 of the mating electrical connector 40, first the manipulative lever 16 is manipulated to rotate so as to cause the curved arm portions 19*a* and 19*b* thereof to ride respectively across the protrusions on the resilient engaging portions 48*a* and 48*b* provided on the conductive shell 42 of the mating electrical connector 40 so as to disengage from the resilient engaging portions 48*a* and 48*b* and to take up the first station as shown in FIG. 11. Then, the electrical connector 11 is moved in its entirety to go away from the mating electrical connector 40 and thereby the connectively engaging protrusion 17 provided on the insulated housing 13 of the electrical connector 11 is caused to get out of the connectively engaging opening 43 provided on the insulated housing 41 and the conductive shell 42 of the mating electrical connector 40.

Although the supporting structure 30*a* provided at the end portion of the conductive shell 14 has the resilient holding portion 31*a* shaped into the groove-like portion and the supporting structure 30*b* provided at the end portion of the conductive shell 14 has the resilient holding portion 31*b* shaped into the groove-like portion in the electrical connector 11 mentioned above, it is also possible to have each of the supporting structure 30*a* and 30*b* provided with any other embodiment of means for supporting the end portion 22*a* or 22*b* of the manipulative lever 16 to be rotatable.

Second Embodiment

Figure 13:
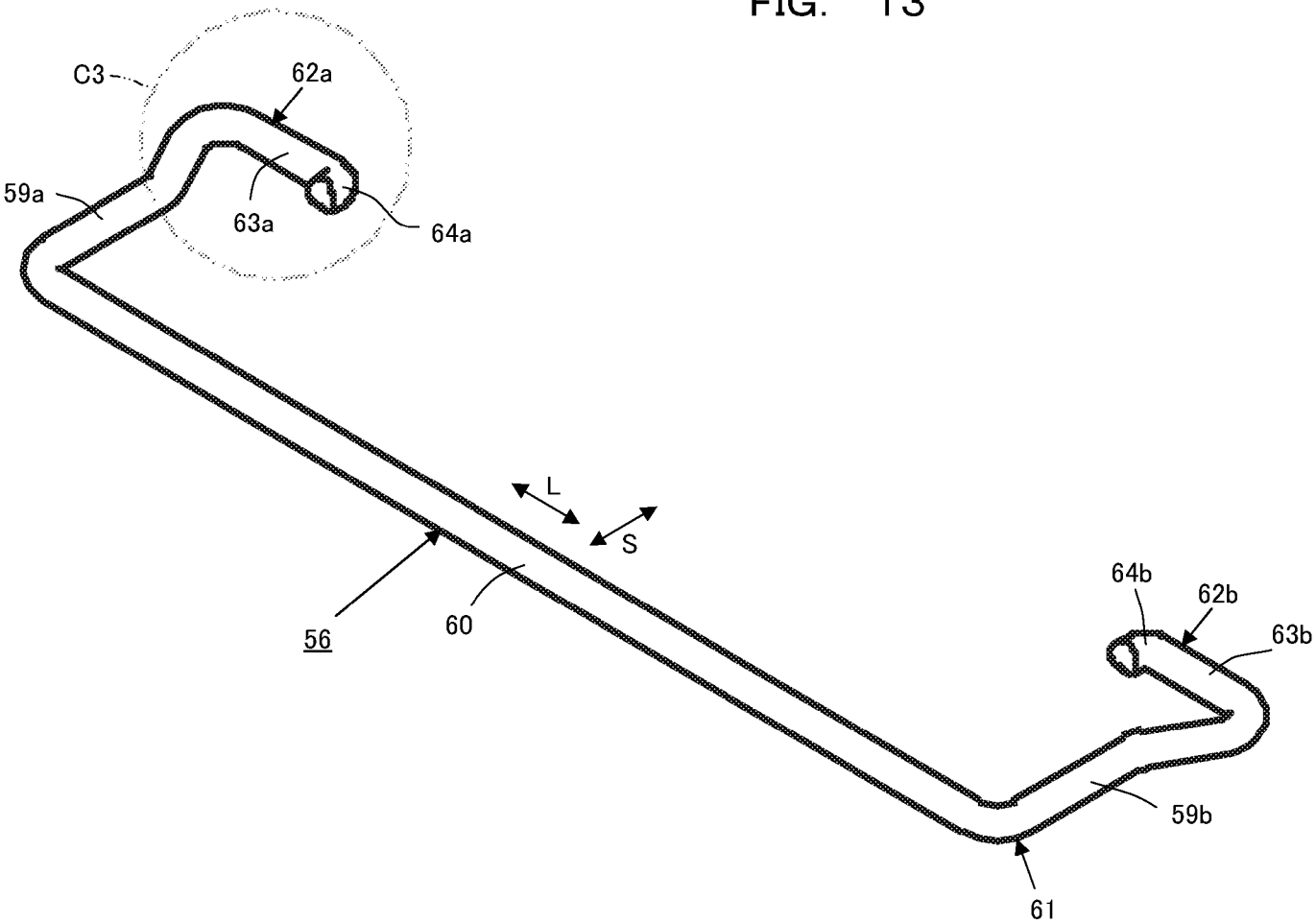
FIG. 13 is a schematic perspective view showing alone a manipulative lever provided to be mounted on a second embodiment of electrical connector according to the present invention.

FIG. 13 shows alone a manipulative lever 56 provided to be mounted on a second embodiment of electrical connector according to the present invention.

The second embodiment of electrical connector provided with the manipulative lever 56 is constituted in the same manner as the first embodiment of electrical connector (the electrical connector 11) described above except the manipulative lever 56. Accordingly, various parts of the second embodiment are illustrated in the drawings with references common to the illustrations showing the first embodiment in the drawings to be explained as occasion demands. A plurality of coaxial cables 12 corresponding to the coaxial cables 12 provided to be electrically connected with the electrical connector 11 are also connected electrically with the second embodiment in the same manner as the coaxial cables 12 connected electrically with the electrical connector 11. Further, the second embodiment is put in engagement with a mating electrical connector 40 corresponding to the mating electrical connector 40 with which the electrical connector 11 is put in engagement in the same manner as the electrical connector 11 put in engagement with the mating electrical connector 40.

Referring to FIG. 13, the manipulative lever 56 has a body portion 61 constituted with a connecting portion 60 elongating in an L direction (a longitudinal direction of an insulated housing of the second embodiment of electrical connector, which is shown with arrow L in FIG. 13) and a pair of curved arm portions 59*a* and 59*b* connected with each other through the connecting portion 60 and a pair of end portions 62*a* and 62*b* connected respectively with both ends of the body portion 61. The end portion 62*a* comprises an elongated portion 63*a* stretching to be bent from the curved arm portion 59*a* provided at one end of the body portion 61 and a top end portion 64*a* stretching further from the elongated portion 63*a* so as to extending as a whole in the L direction. Similarly, the end portion 62*b* comprises an elongated portion 63*b* stretching to be bent from the curved arm portion 59*b* provided at the other end of the body portion 61 and a top end portion 64*b* stretching further from the elongated portion 63*b* so as to extending as a whole in the L direction.

Figure 14:
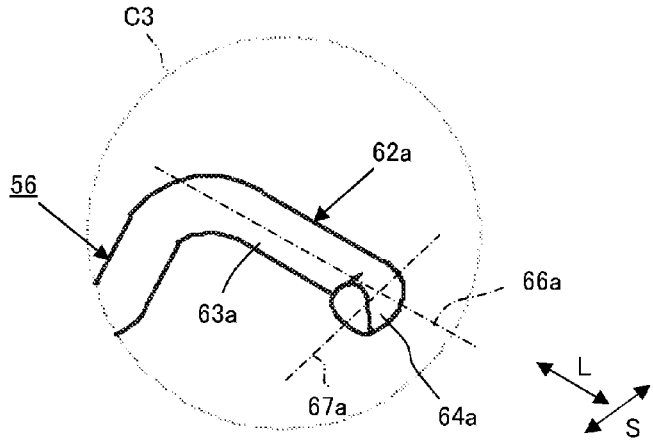
FIG. 14 is a schematic enlarged perspective view showing a part of the manipulative lever surrounded by a circle C3 in FIG. 13.

As shown in FIG. 14 showing a part of the manipulative lever 56 including the end portion 62*a* thereof and surrounded by a circle C3 in FIG. 13, the top end portion 64*a* of the end portion 62*a* is bent at a right angle to protrude from the elongated portion 63*a* of the end portion 62*a* in a direction perpendicular to an imaginary central axis 66*a* of the elongated portion 63*a*. Accordingly, an imaginary central axis 67*a* of the top end portion 64*a* is perpendicular to the imaginary central axis 66*a* of the elongated portion 63*a* and, since the imaginary central axis 66*a* of the elongated portion 63*a* elongates in the L direction, the imaginary central axis 67*a* of the top end portion 64*a* elongates in an S direction (a direction perpendicular to the L direction, which is shown with arrow S in FIG. 13). That is, the imaginary central axis 66*a* of the elongated portion 63*a* elongating in the L direction and the imaginary central axis 67*a* of the top end portion 64*a* elongating in the S direction cross each other at a right angle.

Similarly, the top end portion 64*b* of the end portion 62*b* is bent at a right angle to protrude from the elongated portion 63*b* of the end portion 62*b* in a direction perpendicular to an imaginary central axis of the elongated portion 63*b*. Accordingly, an imaginary central axis of the top end portion 64*b* is perpendicular to the imaginary central axis of the elongated portion 63*b* and, since the imaginary central axis of the elongated portion 63*b* elongates in the L direction, the imaginary central axis of the top end portion 64*b* elongates in the S direction. That is, the imaginary central axis of the elongated portion 63*b* elongating in the L direction and the imaginary central axis of the top end portion 64*b* elongating in the S direction cross each other at a right angle.

The manipulative lever 56 thus constituted is attached to a conductive shell 14 of the second embodiment of electrical connector with the end portion 62*a* thereof comprising the elongated portion 63*a* and the top end portion 64*a* and supported to be rotatable by a supporting structure 30*a* provided at one of end portions in the L direction of the conductive shell 14 and with the end portion 62*b* thereof comprising the elongated portion 63*b* and the top end portion 64*b* and supported to be rotatable by a supporting structure 30*b* provided at the other of end portions in the L direction of the conductive shell 14. The end portion 62*a* of the manipulative lever 56 extends as a whole in a direction from one of end portions to a central portion of an insulated housing 13 of the second embodiment of electrical connector along the L direction and the end portion 62*b* of the manipulative lever 56 extends as a whole in a direction from the other of end portions to the central portion of the insulated housing 13 along the L direction, so that the manipulative lever 56 is provided on the second embodiment of electrical connector to be rotatable in respect to the insulated housing 13. Further, a manipulative tag with which the manipulative lever 56 is easily manipulated to rotate is attached to the connecting portion 60 constituting the body portion 61 of the manipulative lever 56.

Figure 15:
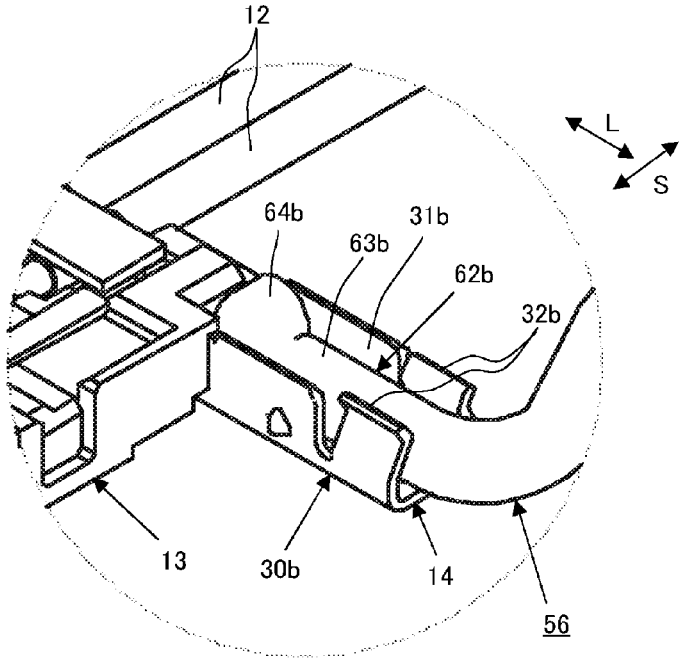
FIG. 15 is a schematic enlarged perspective view showing a part of the second embodiment of electrical connector according to the present invention.

As shown in FIG. 15, the resilient holding portion 31*b* provided in the supporting structure 30*b* is shaped into a groove-like portion elongating in the L direction, in which a part of the end portion 62*b* of the manipulative lever 56 including the elongated portion 63*b* and the top end portion 64*b* is put to be rotatable, and the stopper member 32*b* provided in the supporting structure 30*b* is shaped into a pair of curved wall portions facing each other in the S direction with the elongated portion 63*b* constituting the end portion 62*b* of the manipulative lever 56 between. The groove-like portion formed by the resilient holding portion 31*b* provided in the supporting structure 30*b* is operative to fix the part of the end portion 62*b* of the manipulative lever 56 including the elongated portion 63*b* and the top end portion 64*b* in the S direction. Each of the curved wall portions formed by the stopper member 32*b* provided in the supporting structure 30*b* has an end surface close to the resilient holding portion 31*b* and operative to engage with the top end portion 64*b* constituting the end portion 62*b* of the manipulative lever 56.

Similarly, the resilient holding portion 31*b* provided in the supporting structure 30*a* is shaped into a groove-like portion elongating in the L direction, in which a part of the end portion 62*a* of the manipulative lever 56 including the elongated portion 63*a* and the top end portion 64*a* is put to be rotatable, and the stopper member 32*a* provided in the supporting structure 30*a* is shaped into a pair of curved wall portions facing each other in the S direction with the elongated portion 63*a* constituting the end portion 62*a* of the manipulative lever 56 between. The groove-like portion formed by the resilient holding portion 31*a* provided in the supporting structure 30*a* is operative to fix the part of the end portion 62*a* of the manipulative lever 56 including the elongated portion 63*a* and the top end portion 64*a* in the S direction. Each of the curved wall portions formed by the stopper member 32*a* provided in the supporting structure 30*a* has an end surface close to the resilient holding portion 31*a* and operative to engage with the top end portion 64*a* constituting the end portion 62*a* of the manipulative lever 56.

Under such a condition as mentioned above, the resilient holding portion 31*a* of the supporting structure 30*a* provided at the end portion of the conductive shell 14 is operative to hold the end portion 62*a* of the manipulative lever 56 comprising the elongated portion 63*a* and the top end portion 64*a* thereof and put in the groove-like portion formed by the resilient holding portion 31*a* in such a manner that the top end portion 64*a* is allowed to shift its protruding direction in response to the rotary movement of the manipulative lever 56. Similarly, the resilient holding portion 31*b* of the supporting structure 30*b* provided at the end portion of the conductive shell 14 is operative to hold the end portion 62*b* of the manipulative lever 56 comprising the elongated portion 63*b* and the top end portion 64*b* thereof and put in the groove-like portion formed by the resilient holding portion 31*b* in such a manner that the top end portion 64*b* is allowed to shift its protruding direction in response to the rotary movement of the manipulative lever 56.

Figure 16:
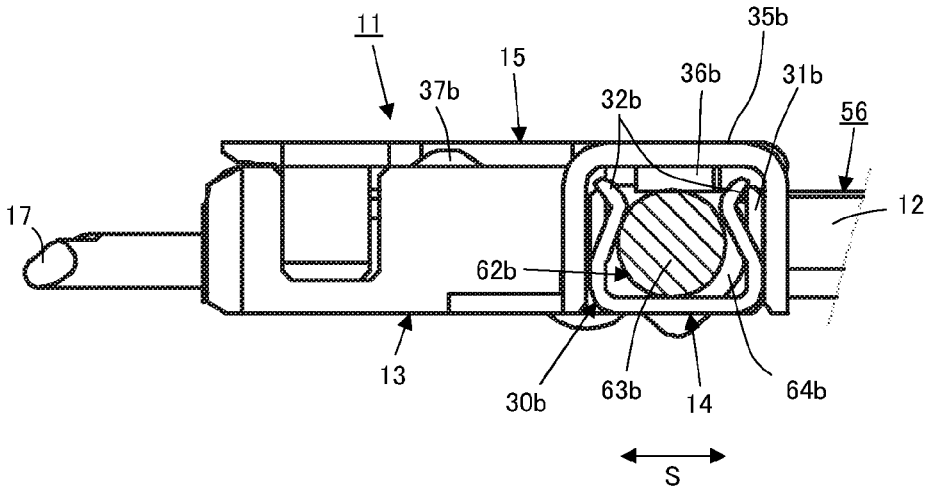
FIG. 16 is a schematic side view showing the second embodiment of electrical connector according to the present invention, a part of which is cut out to expose a cross section.

When the manipulative lever 56 is rotated in respect to the insulated housing 13 so that the body portion 61 of the manipulative lever 56 is put on the side of the coaxial cables 12 connected electrically with the second embodiment of electrical connector, as shown in FIG. 16, in the groove-like portion formed by the resilient holding portion 31*b* of the supporting structure 30*b* provided at the end portion of the conductive shell 14, the top end portion 64*b* constituting the end portion 62*b* of the manipulative lever 56 is put in such a condition as to protrude in the S direction from the elongated portion 63*b* constituting the end portion 62*b* of the manipulative lever 56 toward the coaxial cables 12. Accordingly, in the groove-like portion formed by the resilient holding portion 31*b* of the supporting structure 30*b*, the elongated portion 63*b* is positioned on the side of a connectively engaging protrusion 17 provided on the insulated housing 13 of the second embodiment of electrical connector in the S direction and the top end portion 64*b* is positioned on the side of the coaxial cables 12 in the S direction.

A restrainer member 36*b* provided at an end portion 35*b* in the L direction of a conductive cover 15 of the second embodiment of electrical connector is operative to come into contact with the end portion 62*b* of the manipulative lever 56 supported by the supporting structure 30*b* for restraining the same.

Then, when an external force acts on the manipulative lever 56 so as to move the end portion 62*b* of the manipulative lever 56 in the L direction toward the outside of the insulated housing 13, the end surface close to the resilient holding portion 31*b* of the stopper member 32*b* provided in the supporting structure 30*b* engages with the top end portion 64*b* constituting the end portion 62*b* of the manipulative lever 56 to restrain movements of the same. Thereby, the end portion 62*b* of the manipulative lever 56 is surely prevented from getting out of the supporting structure 30*b*.

Further, in the groove-like portion formed by the resilient holding portion 31*a* of the supporting structure 30*a* provided at the end portion of the conductive shell 14, the top end portion 64*a* constituting the end portion 62*a* of the manipulative lever 56 is put in such a condition as to protrude in the S direction from the elongated portion 63*a* constituting the end portion 62*a* of the manipulative lever 56 toward the coaxial cables 12. Accordingly, in the groove-like portion formed by the resilient holding portion 31*a* of the supporting structure 30*a*, the elongated portion 63*a* is positioned on the side of a connectively engaging protrusion 17 provided on the insulated housing 13 of the second embodiment of electrical connector in the S direction and the top end portion 64*a* is positioned on the side of the coaxial cables 12 in the S direction.

A restrainer member 36*a* provided at an end portion 35*a* in the L direction of the conductive cover 15 is operative to come into contact with the end portion 62*a* of the manipulative lever 56 supported by the supporting structure 30*a* for restraining the same.

Then, when an external force acts on the manipulative lever 56 so as to move the end portion 62*a* of the manipulative lever 56 in the L direction toward the outside of the insulated housing 13, the end surface close to the resilient holding portion 31*a* of the stopper member 32*a* provided in the supporting structure 30*a* engages with the top end portion 64*a* constituting the end portion 62*a* of the manipulative lever 56 to restrain movements of the same. Thereby, the end portion

62*a* of the manipulative lever 56 is surely prevented from getting out of the supporting structure 30*a*.

Figure 17:
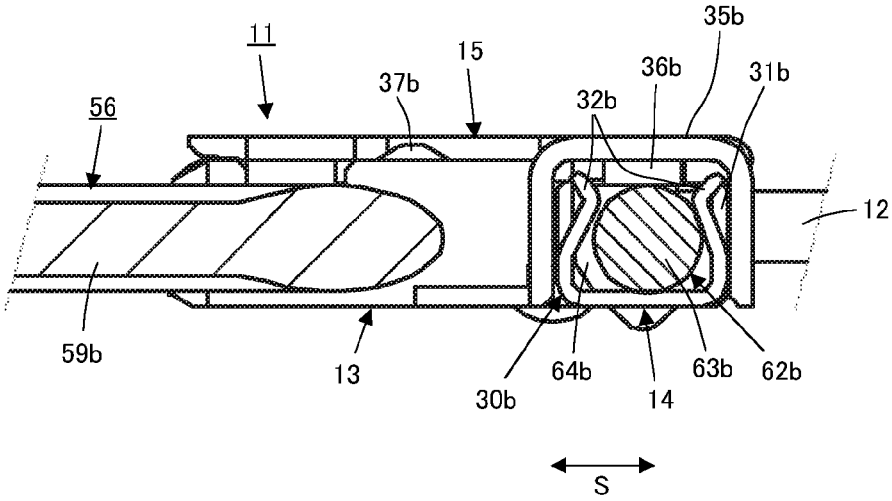
FIG. 17 is a schematic side view showing the second embodiment of electrical connector according to the present invention, a part of which is cut out to expose a cross section.

On the other hand, when the manipulative lever 56 is rotated in respect to the insulated housing 13 so that the body portion 61 of the manipulative lever 56 is put on the side of the connectively engaging protrusion 17 provided on the insulated housing 13 as shown in FIG. 17, in the groove-like portion formed by the resilient holding portion 31*b* of the supporting structure 30*b* provided at the end portion of the conductive shell 14, the top end portion 64*b* constituting the end portion 62*b* of the manipulative lever 56 is put in such a condition as to protrude in the S direction from the elongated portion 63*b* constituting the end portion 62*b* of the manipulative lever 56 toward the connectively engaging protrusion 17 provided on the insulated housing 13 (which is opposite to the coaxial cables 12). Accordingly, in the groove-like portion formed by the resilient holding portion 31*b* of the supporting structure 30*b*, the elongated portion 63*b* is positioned on the side of the coaxial cables 12 in the S direction and the top end portion 64*b* is positioned on the side of the connectively engaging protrusion 17 provided on the insulated housing 13 in the S direction.

At that time also, a restrainer member 36*b* provided at an end portion 35*b* in the L direction of the conductive cover 15 is operative to come into contact with the end portion 62*b* of the manipulative lever 56 supported by the supporting structure 30*b* for restraining the same.

Then, when an external force acts on the manipulative lever 56 so as to move the end portion 62*b* of the manipulative lever 56 in the L direction toward the outside of the insulated housing 13, the end surface close to the resilient holding portion 31*b* of the stopper member 32*b* provided in the supporting structure 30*b* engages with the top end portion 64*b* constituting the end portion 62*b* of the manipulative lever 56 to restrain movements of the same. Thereby, the end portion 62*b* of the manipulative lever 56 is surely prevented from getting out of the supporting structure 30*b*.

Further, in the groove-like portion formed by the resilient holding portion 31*a* of the supporting structure 30*a* provided at the end portion of the conductive shell 14, the top end portion 64*a* constituting the end portion 62*a* of the manipulative lever 56 is put in such a condition as to protrude in the S direction from the elongated portion 63*a* constituting the end portion 62*a* of the manipulative lever 56 toward the connectively engaging protrusion 17 provided on the insulated housing 13 (which is opposite to the coaxial cables 12). Accordingly, in the groove-like portion formed by the resilient holding portion 31*a* of the supporting structure 30*a*, the elongated portion 63*a* is positioned on the side of the coaxial cables 12 in the S direction and the top end portion 64*a* is positioned on the side of the connectively engaging protrusion 17 provided on the insulated housing 13 in the S direction.

At that time also, a restrainer member 36*a* provided at an end portion 35*a* in the L direction of the conductive cover 15 is operative to come into contact with the end portion 62*a* of the manipulative lever 56 supported by the supporting structure 30*a* for restraining the same.

Then, when an external force acts on the manipulative lever 56 so as to move the end portion 62*a* of the manipulative lever 56 in the L direction toward the outside of the insulated housing 13, the end surface close to the resilient holding portion 31*a* of the stopper member 32*a* provided in the supporting structure 30*a* engages with the top end portion 64*a* constituting the end portion 62*a* of the manipulative lever 56 to restrain movements of the same. Thereby, the end portion 62*a* of the manipulative lever 56 is surely prevented from getting out of the supporting structure 30*a*.

In addition, in the case where the manipulative lever 56 is rotated in respect to the insulated housing 13 so that the body portion 61 of the manipulative lever 56 is located at a position between the position on the side of the coaxial cables 12 and the position on the side of the connectively engaging protrusion 17 provided on the insulated housing 13 and an external force acts on the manipulative lever 56 so as to move the end portion 62*a* or 62*b* of the manipulative lever 56 in the L direction toward the outside of the insulated housing 13, the end surface close to the resilient holding portion 31*a* of the stopper member 32*a* provided in the supporting structure 30*a* engages with the top end portion 64*a* constituting the end portion 62*a* of the manipulative lever 56 to restrain movements of the same, or the end surface close to the resilient holding portion 31*b* of the stopper member 32*b* provided in the supporting structure 30*b* engages with the top end portion 64*b* constituting the end portion 62*b* of the manipulative lever 56 to restrain movements of the same. Thereby, the end portions 62*a* and 62*b* of the manipulative lever 56 are surely prevented from getting respectively out of the supporting structures 30*a* and 30*b*.

When the second embodiment of electrical connector having the manipulative lever 56 is put in engagement with the mating electrical connector 40 fixed to the solid printed circuit board to be electrically connected with the electric circuit portion provided thereon, the connectively engaging protrusion 17 provided on the insulated housing 13 is inserted in the S direction into the connectively engaging opening 43 provided on the insulated housing 41 and the conductive shell 42 of the mating electrical connector 40 to be engaged with the same. At that time, the manipulative lever 56 takes up a first station wherein the body portion 61 of the manipulative lever 56 is put on the side of the coaxial cables 12 connected electrically with the second embodiment of electrical connector.

Then, the manipulative lever 56 is manipulated to rotate from the first station wherein the body portion 61 of the manipulative lever 56 is put on the side of the coaxial cables 12 connected electrically with the second embodiment of electrical connector to a second station wherein the body portion 61 of the manipulative lever 56 is put on the side of the connectively engaging protrusion 17 provided on the insulated housing 13 of the second embodiment of electrical connector.

When the manipulative lever 56 provided in the second embodiment of electrical connector takes up the second station wherein the body portion 61 of the manipulative lever 56 is put on the side of the connectively engaging protrusion 17 provided on the insulated housing 13 of the second embodiment of electrical connector, the curved arm portions 59*a* and 59*b* of the manipulative lever 56 are caused to ride respectively across protrusions on the resilient engaging portions 48*a* and 48*b* provided on the conductive shell 42 of the mating electrical connector 40 so as to engage with the resilient engaging portions 48*a* and 48*b*. Thereby, the manipulative lever 56 is stationed on the mating electrical connector 40.

Under a condition wherein the curved arm portions 59*a* and 59*b* of the manipulative lever 56 are put respectively in engagement with the resilient engaging portions 48*a* and 48*b* provided on the conductive shell 42 of the mating electrical connector 40, the body portion 61 of the manipulative lever 56 is put on the side of the connectively engaging protrusion 17 provided on the insulated housing 13 of the second embodiment of electrical connector. Accordingly, in the groove-like portion formed by the resilient holding portion 31*a* of the supporting structure 30*a* provided at the end portion of the conductive shell 14 of the second embodiment of electrical connector, the elongated portion 63*a* is positioned on the side of the coaxial cables 12 in the S direction and the top end portion 64*a* is positioned on the side of the connectively engaging protrusion 17 provided on the insulated housing 13 in the S direction, and in the groove-like portion formed by the resilient holding portion 31*b* of the supporting structure 30*b* provided at the end portion of the conductive shell 14 of the second embodiment of electrical connector, the elongated portion 63*b* is positioned on the side of the coaxial cables 12 in the S direction and the top end portion 64*b* is positioned on the side of the connectively engaging protrusion 17 provided on the insulated housing 13 in the S direction.

Accordingly, the end portion 62*a* of the manipulative lever 56 is pressed resiliently by the resilient holding portion 31*a* of the supporting structure 30*a* toward the coaxial cables 12 connected electrically with the second embodiment of electrical connector in the S direction and simultaneously the end portion 62*b* of the manipulative lever 56 is also pressed resiliently by the resilient holding portion 31*b* of the supporting structure 30*b* toward the coaxial cables 12 connected electrically with the second embodiment of electrical connector in the S direction, so that the body portion 61 of the manipulative lever 56 constituted with the curved arm portions 59*a* and 59*b* and the connecting portion 60 is forced to move toward the coaxial cables 12 in the S direction. That is, the elongated portion 63*a* and the top end portion 64*a* constituting the end portion 62*a* of the manipulative lever 56 supported by the supporting structure 30*a* and the elongated portion 63*b* and the top end portion 64*b* constituting the end portion 62*b* of the manipulative lever 56 supported by the supporting structure 30*a* are operative to exert, on the manipulative lever 56 having the curved arm portions 59*a* and 59*b* engaged respectively with the resilient engaging portions 48*a* and 48*b*, such resilient force as to move the body portion 61 of the manipulative lever 56 toward the coaxial cables 12 connected electrically with the second embodiment of electrical connector in the S direction.

With the resilient force thus caused to act on the manipulative lever 56 by the end portions 62*a* and 62*b* of the manipulative lever 56, the body portion 61 of the manipulative lever 56 having the curved arm portions 59*a* and 59*b* engaged respectively with the resilient engaging portions 48*a* and 48*b* is pressed against the mating electrical connector 40. Accordingly, the elongated portion 63*a* and the top end portion 64*a* constituting the end portion 62*a* of the manipulative lever 56 supported by the supporting structure 30*a* and the elongated portion 63*b* and the top end portion 64*b* constituting the end portion 62*b* of the manipulative lever 56 supported by the supporting structure 30*b* are operative to exert, on the manipulative lever 56 having the curved arm portions 59*a* and 59*b* engaged respectively with the resilient engaging portions 48*a* and 48*b*, the resilient force for pressing the body portion 61 of the manipulative lever 56 against the mating electrical connector 40.

With the body portion 61 of the manipulative lever 56 thus pressed against the mating electrical connector 40 by the resilient force brought about by the end portions 62*a* and 62*b* of the manipulative lever 56, an undesirable condition wherein a vacant space is formed between the manipulative lever 56 having the curved arm portions 59*a* and 59*b* engaged respectively with the resilient engaging portions 48*a* and 48*b* provided on the conductive shell 42 of the mating electrical connector 40 and the mating electrical connector 40 and thereby the manipulative lever 56 comes to unsteadiness so as to produce an undesirable noise, can be surely avoided.

Even under the condition wherein the second embodiment of electrical connector is put in engagement with the mating electrical connector 40, as described above, when an external force acts on the manipulative lever 56 so as to move the end portion 62*a* of the manipulative lever 56 in the L direction toward the outside of the insulated housing 13 of the second embodiment of electrical connector, the end surface close to the resilient holding portion 31*a* of the stopper member 32*a* provided in the supporting structure 30*a* engages with the top end portion 64*a* constituting the end portion 62*a* of the manipulative lever 56 to restrain movements of the same, so that the end portion 62*a* of the manipulative lever 56 is surely prevented from getting out of the supporting structure 30*a*, and similarly, when an external force acts on the manipulative lever 56 so as to move the end portion 62*b* of the manipulative lever 56 in the L direction toward the outside of the insulated housing 13 of the second embodiment of electrical connector, the end surface close to the resilient holding portion 31*b* of the stopper member 32*b* provided in the supporting structure 30*b* engages with the top end portion 64*b* constituting the end portion 62*b* of the manipulative lever 56 to restrain movements of the same, and thereby, the end portion 62*b* of the manipulative lever 56 is surely prevented from getting out of the supporting structure 30*b*.

In such a manner as described above, with the manipulative lever 56 taking up the second station wherein the body portion 61 of the manipulative lever 56 is put on the side of the connectively engaging protrusion 17 provided on the insulated housing 13 of the second embodiment of electrical connector, the condition wherein the connectively engaging protrusion 17 provided on the insulated housing 13 is engaged with the conductive engaging opening 43 provided on the insulated housing 41 of the mating electrical connector 40 is more surely and stably maintained.

After that, when the connectively engaging protrusion 17 provided on the insulated housing 13 of the second embodiment of electrical connector is disengaged from the conductive engaging opening 43 provided on the insulated housing 41 of the mating electrical connector 40, first the manipulative lever 56 is manipulated to rotate so as to cause the curved arm portions 59*a* and 59*b* thereof to ride respectively across the protrusions on the resilient engaging portions 48*a* and 48*b* provided on the conductive shell 42 of the mating electrical connector 40 so as to disengage from the resilient engaging portions 48*a* and 48*b* and to take up the first station wherein the body portion 61 of the manipulative lever 56 is put on the side of the coaxial cables 12 connected electrically with the second embodiment of electrical connector. Then, the second embodiment of electrical connector is moved in its entirety to go away from the mating electrical connector 40 and thereby the connectively engaging protrusion 17 provided on the insulated housing 13 of the second embodiment of electrical connector is caused to get out of the connectively engaging opening 43 provided on the insulated housing 41 of the mating electrical connector 40.

Although the supporting structure 30*a* provided at the end portion of the conductive shell 14 of the second embodiment of electrical connector has the resilient holding portion 31*a* shaped into the groove-like portion and the supporting structure 30*b* provided at the end portion of the conductive shell 14 has the resilient holding portion 31*b* shaped into the groove-like portion in the electrical connector 11 mentioned above, it is also possible to have each of the supporting structure 30*a* and 30*b* provided with any other embodiment of means for supporting the end portion 62*a* or 62*b* of the manipulative lever 56 to be rotatable.

Third Embodiment

Figure 18:
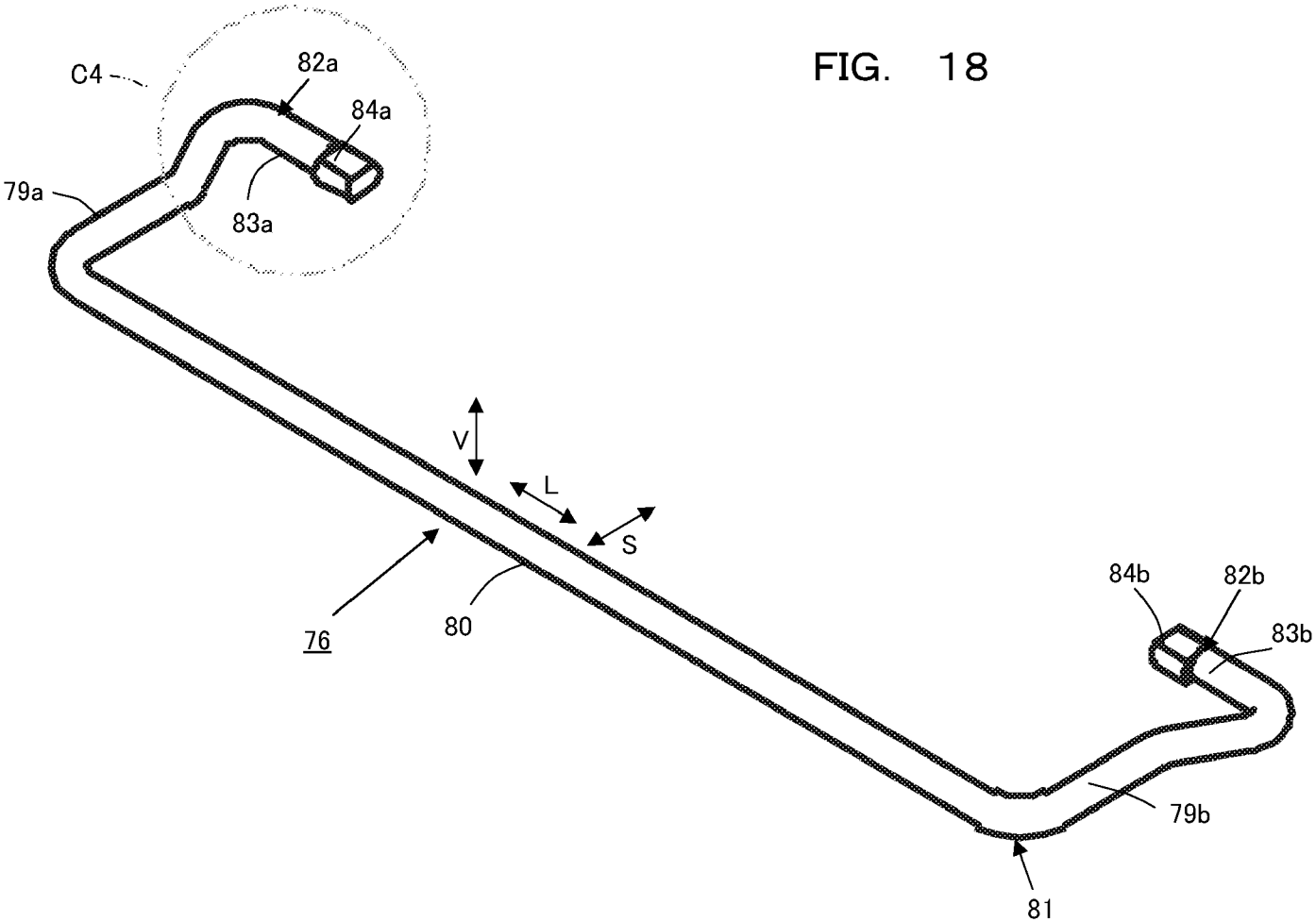
FIG. 18 is a schematic perspective view showing alone a manipulative lever provided to be mounted on a third embodiment of electrical connector according to the present invention.

FIG. 18 shows alone a manipulative lever 76 provided to be mounted on a third embodiment of electrical connector according to the present invention.

The third embodiment of electrical connector provided with the manipulative lever 76 is constituted in the same manner as the first embodiment of electrical connector (the electrical connector 11) described above except the manipulative lever 76. Accordingly, various parts of the third embodiment are illustrated in the drawings with references common to the illustrations showing the first embodiment in the drawings to be explained as occasion demands. A plurality of coaxial cables 12 corresponding to the coaxial cables 12 provided to be electrically connected with the electrical connector 11 are also connected electrically with the second embodiment in the same manner as the coaxial cables 12 connected electrically with the electrical connector 11. Further, the second embodiment is put in engagement with a mating electrical connector 40 corresponding to the mating electrical connector 40 with which the electrical connector 11 is put in engagement in the same manner as the electrical connector 11 put in engagement with the mating electrical connector 40.

Referring to FIG. 18, the manipulative lever 76 has a body portion 81 constituted with a connecting portion 80 elongating in an L direction (a longitudinal direction of an insulated housing of the third embodiment of electrical connector, which is shown with arrow L in FIG. 18) and a pair of curved arm portions 79*a* and 79*b* connected with each other through the connecting portion 80 and a pair of end portions 82*a* and 82*b* connected respectively with both ends of the body portion 81. The end portion 82*a* comprises an elongated portion 83*a* stretching to be bent from the curved arm portion 79*a* provided at one end of the body portion 81 and a top end portion 84*a* stretching further from the elongated portion 83*a* so as to extending as a whole in the L direction. Similarly, the end portion 82*b* comprises an elongated portion 83*b* stretching to be bent from the curved arm portion 79*b* provided at the other end of the body portion 81 and a top end portion 84*b* stretching further from the elongated portion 83*b* so as to extending as a whole in the L direction.

Figure 19:
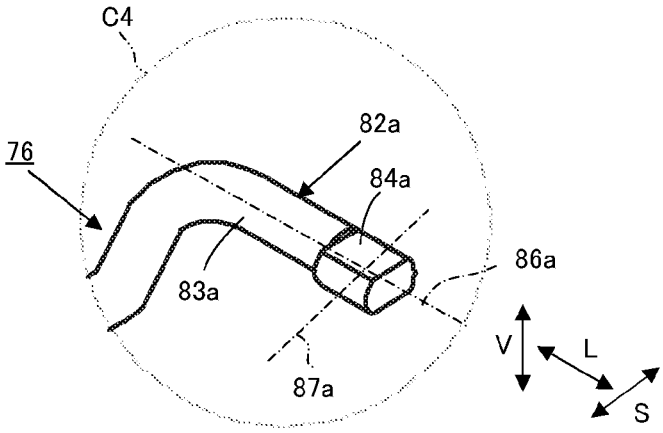
FIG. 19 is a schematic enlarged perspective view showing a part of the manipulative lever surrounded be a circle C4 in FIG. 18.

As shown in FIG. 19 showing a part of the manipulative lever 76 including the end portion 82*a* thereof and surrounded by a circle C4, the top end portion 84*a* of the end portion 82*a* is compressed in a V direction perpendicular to a direction of an imaginary central axis 86*a* of the elongated portion 83*a* (the L direction), which is shown with arrow V in FIGS. 18 and 19, so as to protrude from the elongated portion 83*a* in an S direction perpendicular to each of the L direction and the V direction, which is shown with arrow S in FIGS. 18 and 19. Accordingly, the imaginary central axis 86*a* of the elongated portion 83*a* elongating in the L direction and an imaginary central axis 87*a* of the top end portion 84*a* elongating in the S direction cross each other at a right angle.

Similarly, the top end portion 84*b* of the end portion 82*b* is compressed in the V direction perpendicular to a direction of an imaginary central axis of the elongated portion 83*b* of the end portion 82*b* (the L direction) so as to protrude from the elongated portion 83*b* in the S direction perpendicular to each of the L direction and the V direction. Accordingly, the imaginary central axis of the elongated portion 83*b* elongating in the L direction and an imaginary central axis of the top end portion 84*b* elongating in the S direction cross each other at a right angle.

The manipulative lever 76 thus constituted is attached to a conductive shell 14 of the third embodiment of electrical connector with the end portion 82*a* thereof comprising the elongated portion 83*a* and the top end portion 84*a* and supported to be rotatable by a supporting structure 30*a* provided at one of end portions in the L direction of the conductive shell 14 and with the end portion 82*b* thereof comprising the elongated portion 83*b* and the top end portion 84*b* and supported to be rotatable by a supporting structure 30*b* provided at the other of end portions in the L direction of the conductive shell 14. The end portion 82*a* of the manipulative lever 76 extends as a whole in a direction from one of end portions to a central portion of an insulated housing 13 of the third embodiment of electrical connector along the L direction and the end portion 82*b* of the manipulative lever 76 extends as a whole in a direction from the other of end portions to the central portion of the insulated housing 13 along the L direction, so that the manipulative lever 76 is provided on the third embodiment of electrical connector to be rotatable in respect to the insulated housing 13. Further, a manipulative tag with which the manipulative lever 76 is easily manipulated to rotate is attached to the connecting portion 80 constituting the body portion 81 of the manipulative lever 76.

Figure 20:
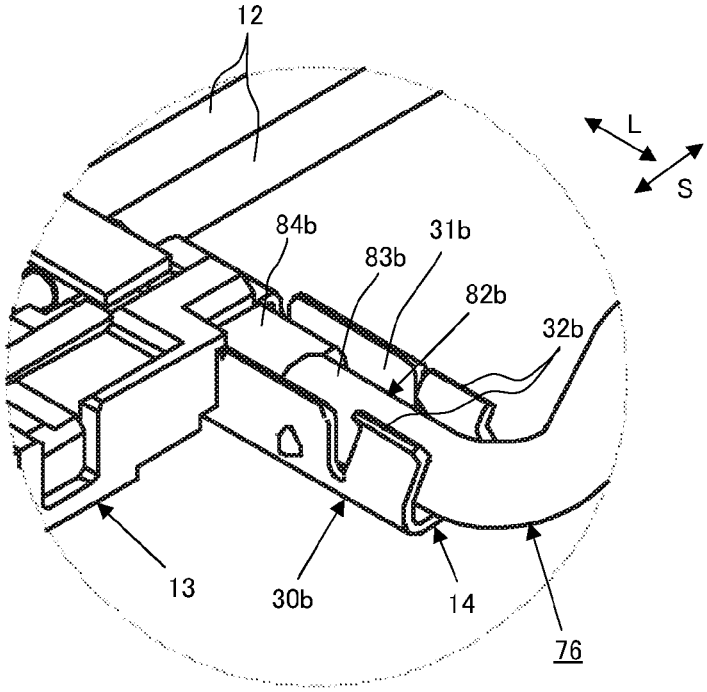
FIG. 20 is a schematic enlarged perspective view showing a part of the third embodiment of electrical connector according to the present invention.

As shown in FIG. 20, a resilient holding portion 31*b* provided in the supporting structure 30*b* provided at the end portion of the conductive shell 14 is shaped into a groove-like portion elongating in the L direction, in which a part of the end portion 82*b* of the manipulative lever 76 including the elongated portion 83*b* and the top end portion 84*b* is put to be rotatable, and a stopper member 32*b* provided in the supporting structure 30*b* is shaped into a pair of curved wall portions facing each other in the S direction with the elongated portion 83*b* constituting the end portion 82*b* of the manipulative lever 76 between. The groove-like portion formed by the resilient holding portion 31*b* provided in the supporting structure 30*b* is operative to fix the part of the end portion 82*b* of the manipulative lever 76 including the elongated portion 83*b* and the top end portion 84*b* in the S direction. Each of the curved wall portions formed by the stopper member 32*b* provided in the supporting structure 30*b* has an end surface close to the resilient holding portion 31*b* and operative to engage with the top end portion 84*b* constituting the end portion 82*b* of the manipulative lever 76.

Similarly, a resilient holding portion 31*b* provided in the supporting structure 30*a* provided at the end portion of the conductive shell 14 is shaped into a groove-like portion elongating in the L direction, in which a part of the end portion 82*a* of the manipulative lever 76 including the elongated portion 83*a* and the top end portion 84*a* is put to be rotatable, and a stopper member 32*a* provided in the supporting structure 30*a* is shaped into a pair of curved wall portions facing each other in the S direction with the elongated portion 83*a* constituting the end portion 82*a* of the manipulative lever 76 between. The groove-like portion formed by the resilient holding portion 31*a* provided in the supporting structure 30*a* is operative to fix the part of the end portion 82*a* of the manipulative lever 76 including the elongated portion 83*a* and the top end portion 84*a* in the S direction. Each of the curved wall portions formed by the stopper member 32*a* provided in the supporting structure 30*a* has an end surface close to the resilient holding portion 31*a* and operative to engage with the top end portion 84*a* constituting the end portion 82*a* of the manipulative lever 76.

Under such a condition as mentioned above, the resilient holding portion 31*a* of the supporting structure 30*a* provided at the end portion of the conductive shell 14 is operative to hold the end portion 82*a* of the manipulative lever 76 comprising the elongated portion 83*a* and the top end portion 84*a* thereof and put in the groove-like portion formed by the resilient holding portion 31*a* in such a manner that the top end portion 84*a* is allowed to shift its protruding direction in response to the rotary movement of the manipulative lever 76. Similarly, the resilient holding portion 31*b* of the supporting structure 30*b* provided at the end portion of the conductive shell 14 is operative to hold the end portion 82*b* of the manipulative lever 76 comprising the elongated portion 83*b* and the top end portion 84*b* thereof and put in the groove-like portion formed by the resilient holding portion 31*b* in such a manner that the top end portion 84*b* is allowed to shift its protruding direction in response to the rotary movement of the manipulative lever 76.

Figure 21:
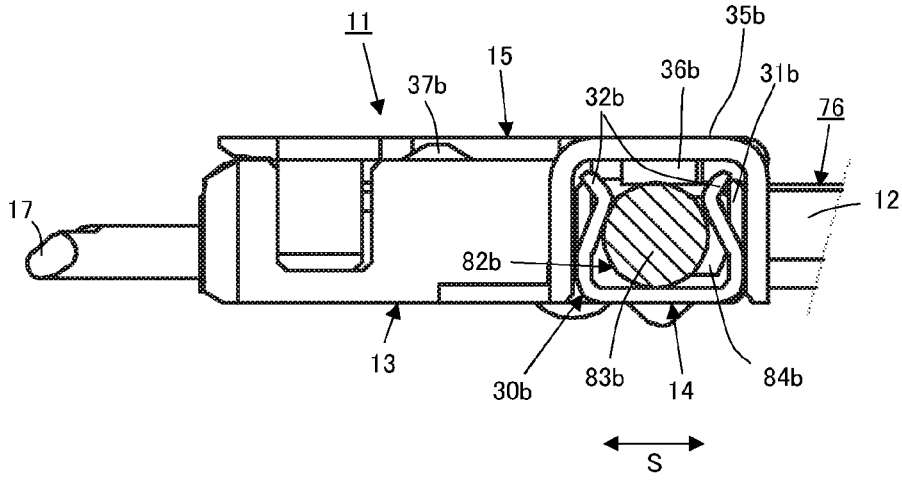
FIG. 21 is a schematic side view showing the third embodiment of electrical connector according to the present invention, a part of which is cut out to expose a cross section.

When the manipulative lever 76 is rotated in respect to the insulated housing 13 so that the body portion 81 of the manipulative lever 76 is put on the side of the coaxial cables 12 connected electrically with the third embodiment of electrical connector, as shown in FIG. 21, in the groove-like portion formed by the resilient holding portion 31*b* of the supporting structure 30*b* provided at the end portion of the conductive shell 14, the top end portion 84*b* constituting the end portion 82*b* of the manipulative lever 76 is put in such a condition as to protrude in the S direction from the elongated portion 83*b* constituting the end portion 82*b* of the manipulative lever 76 toward the coaxial cables 12. Accordingly, in the groove-like portion formed by the resilient holding portion 31*b* of the supporting structure 30*b*, the elongated portion 83*b* is positioned on the side of a connectively engaging protrusion 17 provided on the insulated housing 13 of the third embodiment of electrical connector in the S direction and the top end portion 84*b* is positioned on the side of the coaxial cables 12 in the S direction.

A restrainer member 36*b* provided at an end portion 35*b* in the L direction of a conductive cover 15 of the third embodiment of electrical connector is operative to come into contact with the end portion 82*b* of the manipulative lever 76 supported by the supporting structure 30*b* for restraining the same.

Then, when an external force acts on the manipulative lever 76 so as to move the end portion 82*b* of the manipulative lever 76 in the L direction toward the outside of the insulated housing 13, the end surface close to the resilient holding portion 31*b* of the stopper member 32*b* provided in the supporting structure 30*b* engages with the top end portion 84*b* constituting the end portion 82*b* of the manipulative lever 76 to restrain movements of the same. Thereby, the end portion 82*b* of the manipulative lever 76 is surely prevented from getting out of the supporting structure 30*b*.

Further, in the groove-like portion formed by the resilient holding portion 31*a* of the supporting structure 30*a* provided at the end portion of the conductive shell 14, the top end portion 84*a* constituting the end portion 82*a* of the manipulative lever 76 is put in such a condition as to protrude in the S direction from the elongated portion 83*a* constituting the end portion 82*a* of the manipulative lever 76 toward the coaxial cables 12. Accordingly, in the groove-like portion formed by the resilient holding portion 31*a* of the supporting structure 30*a*, the elongated portion 83*a* is positioned on the side of a connectively engaging protrusion 17 provided on the insulated housing 13 of the third embodiment of electrical connector in the S direction and the top end portion 84*a* is positioned on the side of the coaxial cables 12 in the S direction.

A restrainer member 36*a* provided at an end portion 35*a* in the L direction of the conductive cover 15 is operative to come into contact with the end portion 82*a* of the manipulative lever 76 supported by the supporting structure 30*a* for restraining the same.

Then, when an external force acts on the manipulative lever 76 so as to move the end portion 82*a* of the manipulative lever 76 in the L direction toward the outside of the insulated housing 13, the end surface close to the resilient holding portion 31*a* of the stopper member 32*a* provided in the supporting structure 30*a* engages with the top end portion 84*a* constituting the end portion 82*a* of the manipulative lever 76 to restrain movements of the same. Thereby, the end portion 82*a* of the manipulative lever 76 is surely prevented from getting out of the supporting structure 30*a*.

Figure 22:
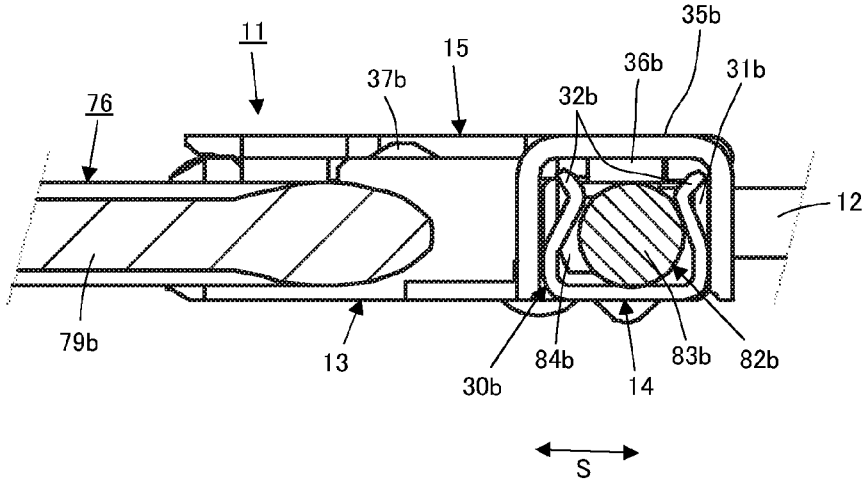
FIG. 22 is a schematic side view showing the third embodiment of electrical connector according to the present invention, a part of which is cut out to expose a cross section.

On the other hand, when the manipulative lever 76 is rotated in respect to the insulated housing 13 so that the body portion 81 of the manipulative lever 76 is put on the side of the connectively engaging protrusion 17 provided on the insulated housing 13 as shown in FIG. 22, in the groove-like portion formed by the resilient holding portion 31*b* of the supporting structure 30*b* provided at the end portion of the conductive shell 14, the top end portion 84*b* constituting the end portion 82*b* of the manipulative lever 76 is put in such a condition as to protrude in the S direction from the elongated portion 83*b* constituting the end portion 82*b* of the manipulative lever 76 toward the connectively engaging protrusion 17 provided on the insulated housing 13 (which is opposite to the coaxial cables 12). Accordingly, in the groove-like portion formed by the resilient holding portion 31*b* of the supporting structure 30*b*, the elongated portion 83*b* is positioned on the side of the coaxial cables 12 in the S direction and the top end portion 84*b* is positioned on the side of the connectively engaging protrusion 17 provided on the insulated housing 13 in the S direction.

At that time also, a restrainer member 36*b* provided at an end portion 35*b* in the L direction of the conductive cover 15 is operative to come into contact with the end portion 82*b* of the manipulative lever 76 supported by the supporting structure 30*b* for restraining the same.

Then, when an external force acts on the manipulative lever 76 so as to move the end portion 82*b* of the manipulative lever 76 in the L direction toward the outside of the insulated housing 13, the end surface close to the resilient holding portion 31*b* of the stopper member 32*b* provided in the supporting structure 30*b* engages with the top end portion 84*b* constituting the end portion 82*b* of the manipulative lever 76 to restrain movements of the same. Thereby, the end portion 82*b* of the manipulative lever 76 is surely prevented from getting out of the supporting structure 30*b*.

Further, in the groove-like portion formed by the resilient holding portion 31*a* of the supporting structure 30*a* provided at the end portion of the conductive shell 14, the top end portion 84*a* constituting the end portion 82*a* of the manipulative lever 76 is put in such a condition as to protrude in the S direction from the elongated portion 83*a* constituting the end portion 82*a* of the manipulative lever 76 toward the connectively engaging protrusion 17 provided on the insulated housing 13 (which is opposite to the coaxial cables 12). Accordingly, in the groove-like portion formed by the resilient holding portion 31*a* of the supporting structure 30*a*, the elongated portion 83*a* is positioned on the side of the coaxial cables 12 in the S direction and the top end portion 84*a* is positioned on the side of the connectively engaging protrusion 17 provided on the insulated housing 13 in the S direction.

At that time also, a restrainer member 36*a* provided at an end portion 35*a* in the L direction of the conductive cover 15 is operative to come into contact with the end portion 82*a* of the manipulative lever 76 supported by the supporting structure 30*a* for restraining the same.

Then, when an external force acts on the manipulative lever 76 so as to move the end portion 82*a* of the manipulative lever 76 in the L direction toward the outside of the insulated housing 13, the end surface close to the resilient holding portion 31*a* of the stopper member 32*a* provided in the supporting structure 30*a* engages with the top end portion 84*a* constituting the end portion 82*a* of the manipulative lever 76 to restrain movements of the same. Thereby, the end portion 82*a* of the manipulative lever 76 is surely prevented from getting out of the supporting structure 30*a*.

In addition, in the case where the manipulative lever 76 is rotated in respect to the insulated housing 13 so that the body portion 81 of the manipulative lever 76 is located at a position between the position on the side of the coaxial cables 12 and the position on the side of the connectively engaging protrusion 17 provided on the insulated housing 13 and an external force acts on the manipulative lever 76 so as to move the end portion 82*a* or 82*b* of the manipulative lever 76 in the L direction toward the outside of the insulated housing 13, the end surface close to the resilient holding portion 31*a* of the stopper member 32*a* provided in the supporting structure 30*a* engages with the top end portion 84*a* constituting the end portion 82*a* of the manipulative lever 76 to restrain movements of the same, or the end surface close to the resilient holding portion 31*b* of the stopper member 32*b* provided in the supporting structure 30*b* engages with the top end portion 84*b* constituting the end portion 82*b* of the manipulative lever 76 to restrain movements of the same. Thereby, the end portions 82*a* and 82*b* of the manipulative lever 76 are surely prevented from getting respectively out of the supporting structures 30*a* and 30*b*.

When the third embodiment of electrical connector having the manipulative lever 76 is put in engagement with the mating electrical connector 40 fixed to the solid printed circuit board to be electrically connected with the electric circuit portion provided thereon, the connectively engaging protrusion 17 provided on the insulated housing 13 is inserted in the S direction into the connectively engaging opening 43 provided on the insulated housing 41 and the conductive shell 42 of the mating electrical connector 40 to be engaged with the same. At that time, the manipulative lever 76 takes up a first station wherein the body portion 81 of the manipulative lever 76 is put on the side of the coaxial cables 12 connected electrically with the third embodiment of electrical connector.

Then, the manipulative lever 76 is manipulated to rotate from the first station wherein the body portion 81 of the manipulative lever 76 is put on the side of the coaxial cables 12 connected electrically with the third embodiment of electrical connector to a second station wherein the body portion 81 of the manipulative lever 76 is put on the side of the connectively engaging protrusion 17 provided on the insulated housing 13 of the third embodiment of electrical connector.

When the manipulative lever 76 provided in the third embodiment of electrical connector takes up the second station wherein the body portion 81 of the manipulative lever 76 is put on the side of the connectively engaging protrusion 17 provided on the insulated housing 13 of the third embodiment of electrical connector, the curved arm portions 79*a* and 79*b* of the manipulative lever 76 are caused to ride respectively across protrusions on the resilient engaging portions 48*a* and 48*b* provided on the conductive shell 42 of the mating electrical connector 40 so as to engage with the resilient engaging portions 48*a* and 48*b*. Thereby, the manipulative lever 76 is stationed on the mating electrical connector 40.

Under a condition wherein the curved arm portions 79*a* and 79*b* of the manipulative lever 76 are put respectively in engagement with the resilient engaging portions 48*a* and 48*b* provided on the conductive shell 42 of the mating electrical connector 40, the body portion 81 of the manipulative lever 76 is put on the side of the connectively engaging protrusion 17 provided on the insulated housing 13 of the third embodiment of electrical connector. Accordingly, in the groove-like portion formed by the resilient holding portion 31*a* of the supporting structure 30*a* provided at the end portion of the conductive shell 14 of the third embodiment of electrical connector, the elongated portion 83*a* is positioned on the side of the coaxial cables 12 in the S direction and the top end portion 84*a* is positioned on the side of the connectively engaging protrusion 17 provided on the insulated housing 13 in the S direction, and in the groove-like portion formed by the resilient holding portion 31*b* of the supporting structure 30*b* provided at the end portion of the conductive shell 14 of the third embodiment of electrical connector, the elongated portion 83*b* is positioned on the side of the coaxial cables 12 in the S direction and the top end portion 84*b* is positioned on the side of the connectively engaging protrusion 17 provided on the insulated housing 13 in the S direction.

Accordingly, the end portion 82*a* of the manipulative lever 76 is pressed resiliently by the resilient holding portion 31*a* of the supporting structure 30*a* toward the coaxial cables 12 connected electrically with the third embodiment of electrical connector in the S direction and simultaneously the end portion 82*b* of the manipulative lever 76 is also pressed resiliently by the resilient holding portion 31*b* of the supporting structure 30*b* toward the coaxial cables 12 connected electrically with the third embodiment of electrical connector in the S direction, so that the body portion 81 of the manipulative lever 76 constituted with the curved arm portions 79*a* and 79*b* and the connecting portion 80 is forced to move toward the coaxial cables 12 in the S direction. That is, the elongated portion 83*a* and the top end portion 84*a* constituting the end portion 82*a* of the manipulative lever 76 supported by the supporting structure 30*a* and the elongated portion 83*b* and the top end portion 84*b* constituting the end portion 82*b* of the manipulative lever 76 supported by the supporting structure 30*b* are operative to exert, on the manipulative lever 76 having the curved arm portions 79*a* and 79*b* engaged respectively with the resilient engaging portions 48*a* and 48*b*, such resilient force as to move the body portion 81 of the manipulative lever 76 toward the coaxial cables 12 connected electrically with the third embodiment of electrical connector in the S direction.

With the resilient force thus caused to act on the manipulative lever 76 by the end portions 82*a* and 82*b* of the manipulative lever 76, the body portion 81 of the manipulative lever 76 having the curved arm portions 79*a* and 79*b* engaged respectively with the resilient engaging portions 48*a* and 48*b* is pressed against the mating electrical connector 40. Accordingly, the elongated portion 83*a* and the top end portion 84*a* constituting the end portion 82*a* of the manipulative lever 76 supported by the supporting structure 30*a* and the elongated portion 83*b* and the top end portion 84*b* constituting the end portion 82*b* of the manipulative lever 76 supported by the supporting structure 30*b* are operative to exert, on the manipulative lever 76 having the curved arm portions 79*a* and 79*b* engaged respectively with the resilient engaging portions 48*a* and 48*b*, the resilient force for pressing the body portion 81 of the manipulative lever 76 against the mating electrical connector 40.

With the body portion 81 of the manipulative lever 76 thus pressed against the mating electrical connector 40 by the resilient force brought about by the end portions 82*a* and 82*b* of the manipulative lever 76, an undesirable condition wherein a vacant space is formed between the manipulative lever 76 having the curved arm portions 79*a* and 79*b* engaged respectively with the resilient engaging portions 48*a* and 48 provided on the conductive shell 42 of the mating electrical connector 40 and the mating electrical connector 40 and thereby the manipulative lever 76 comes to unsteadiness so as to produce an undesirable noise, can be surely avoided.

Even under the condition wherein the third embodiment of electrical connector is put in engagement with the mating electrical connector 40, as described above, when an external force acts on the manipulative lever 76 so as to move the end portion 82*a* of the manipulative lever 76 in the L direction toward the outside of the insulated housing 13 of the third embodiment of electrical connector, the end surface close to the resilient holding portion 31*a* of the stopper member 32*a* provided in the supporting structure 30*a* engages with the top end portion 84*a* constituting the end portion 82*a* of the manipulative lever 76 to restrain movements of the same, so that the end portion 82*a* of the manipulative lever 76 is surely prevented from getting out of the supporting structure 30*a*, and similarly, when an external force acts on the manipulative lever 76 so as to move the end portion 82*b* of the manipulative lever 76 in the L direction toward the outside of the insulated housing 13 of the third embodiment of electrical connector, the end surface close to the resilient holding portion 31*b* of the stopper member 32*b* provided in the supporting structure 30*b* engages with the top end portion 84*b* constituting the end portion 82*b* of the manipulative lever 76 to restrain movements of the same, and thereby, the end portion 82*b* of the manipulative lever 76 is surely prevented from getting out of the supporting structure 30*b*.

In such a manner as described above, with the manipulative lever 76 taking up the second station wherein the body portion 81 of the manipulative lever 76 is put on the side of the connectively engaging protrusion 17 provided on the insulated housing 13 of the third embodiment of electrical connector, the condition wherein the connectively engaging protrusion 17 provided on the insulated housing 13 is engaged with the connectively engaging opening 43 provided on the insulated housing 41 of the mating electrical connector 40 is more surely and stably maintained.

After that, when the connectively engaging protrusion 17 provided on the insulated housing 13 of the third embodiment of electrical connector is disengaged from the connectively engaging opening 43 provided on the insulated housing 41 of the mating electrical connector 40, first the manipulative lever 76 is manipulated to rotate so as to cause the curved arm portions 79*a* and 79*b* thereof to ride respectively across the protrusions on the resilient engaging portions 48*a* and 48*b* provided on the conductive shell 42 of the mating electrical connector 40 so as to disengage from the resilient engaging portions 48*a* and 48*b* and to take up the first station wherein the body portion 81 of the manipulative lever 76 is put on the side of the coaxial cables 12 connected electrically with the third embodiment of electrical connector. Then, the third embodiment of electrical connector is moved in its entirety to go away from the mating electrical connector 40 and thereby the connectively engaging protrusion 17 provided on the insulated housing 13 of the third embodiment of electrical connector is caused to get out of the connectively engaging opening 43 provided on the insulated housing 41 of the mating electrical connector 40.

Although the supporting structure 30*a* provided at the end portion of the conductive shell 14 of the third embodiment of electrical connector has the resilient holding portion 31*a* shaped into the groove-like portion and the supporting structure 30*b* provided at the end portion of the conductive shell 14 has the resilient holding portion 31*b* shaped into the groove-like portion in the electrical connector 11 mentioned above, it is also possible to have each of the supporting structure 30*a* and 30*b* provided with any other embodiment of means for supporting the end portion 82*a* or 82*b* of the manipulative lever 76 to be rotatable.

APPLICABILITY FOR INDUSTRIAL USE

As apparent from the above description, the electrical connector according to the present invention can be applied widely to various kinds of electronic apparatus or the like as an electrical connector which comprises a connectively engaging protrusion provided on an insulated housing to cause a plurality of conductive contacts provided thereon to be connected respectively with a plurality of conductive contacts provided in a mating electrical connector and a manipulative lever provided on a conductive shell covering partially the insulated housing to engage with the mating electrical connector for maintaining the connectively engaging protrusion in engagement with the mating electrical connector, and with which each of end portions of the manipulative lever can be surely prevented from getting out of the conductive shell unwillingly so that the manipulative lever can be maintained in a condition for performing properly its assigned duty even when an external force acts on the manipulative lever so as to move at least one of the end portions of the manipulative lever toward the outside of the insulated housing, and an undesirable condition wherein a vacant space is formed between the manipulative lever put in engagement with the mating electrical connector and the subject mating electrical connector and thereby the manipulative lever comes to unsteadiness can be surely avoided.

The invention claimed is:

1. An electrical connector comprising;

an insulated housing on which a first engaging portion is provided for engaging with a second engaging portion provided in a mating electrical connector, a plurality of first conductive contacts provided on the insulated housing with portions thereof arranged on the first engaging portion and operative to come into contact with a plurality of second conductive contacts provided in the mating electrical connector when the first engaging portion is put in engagement with the second engaging portion, a conductive shell for covering partially the insulated housing, and a manipulative lever having a body portion and a pair of end portions extending respectively from both ends of the body portion, in which the end portions are supported respectively by a pair of supporting structures provided in the conductive shell to be rotatable in regard to the insulated housing and which is operative to be manipulated to rotate so as to cause the body portion to engage with the mating connector when the first engaging portion is put in engagement with the second engaging portion, wherein each of the end portions of the manipulative lever comprises an elongated portion stretching to be bent from the body portion and a top end portion stretching further from the elongated portion so as to extend as a whole in a first direction from an end portion to a central portion of the insulated housing, the top end portion protrudes from the elongated portion in a direction perpendicular to an imaginary central axis of the elongated portion, and a stopper member provided in the supporting structure engages with the top end portion so as to prevent the end portion of the manipulative lever from getting out of the supporting structure when the end portion of the manipulative lever is shifted in a second direction opposite to the first direction under a condition wherein the end portion of the manipulative lever is supported by the supporting structure.

2. An electrical connector according to claim 1, wherein each of the end portions of the manipulative lever comprising the elongated portion and the top end portion and supported by the supporting structure provided in the conductive shell is operative to exert, on the manipulative lever having the body portion thereof put in engagement with the mating electrical connector, such a pressure as to press the body portion of the manipulative lever against the mating electrical connector.

3. An electrical connector according to claim 2, wherein each of the supporting structure is provided, in addition to the stopper member, with a resilient holding portion operative to hold the elongated portion and the top end portion constituting the end portion of the manipulative lever in such a manner that the top end portion in the resilient holding portion is allowed to shift one of a position thereof and a protruding direction thereof in response to a rotary movement of the manipulative lever.

4. An electrical connector according to claim 1, wherein each of the end portions of the manipulative lever has the top end portion which protrudes from the elongated portion in the direction perpendicular to the imaginary central axis of the elongated portion so as to form a stepped portion between the elongated portion and the top end portion and the stopper member provided in the supporting structure engages with the stepped portion so as to prevent the end portion of the manipulative lever from getting out of the supporting structure when the top end portion is shifted in the second direction opposite to the first direction under the condition wherein the end portion of the manipulative lever is supported by the supporting structure.

5. An electrical connector according to claim 1, wherein each of the end portions of the manipulative lever has the top end portion which is bent to protrude from the elongated portion in the direction perpendicular to the imaginary central axis of the elongated portion.

6. An electrical connector according to claim 1, wherein each of the end portions of the manipulative lever has the top end portion which is compressed in a third direction perpendicular to the imaginary central axis of the elongated portion so as to protrude from the elongated portion in a fourth direction perpendicular to each of the imaginary central axis of the elongated portion and the third direction.

7. An electrical connector according to claim 1, wherein the end portions of the manipulative lever are located to be opposite to each other in a direction along both of the first and second directions.

8. An electrical connector according to claim 7, wherein the supporting structures are provided respectively at a pair end portions of the conductive shell corresponding respectively to a pair of end portions in a longitudinal direction of the insulated housing.

9. An electrical connector according to claim 1 further comprises a conductive cover for covering partially the insulated housing, a part of said conductive cover covering also each of the supporting structures provided in the conductive shell.

* * * * *